US006347213B1

(12) United States Patent
Yamanaka et al.

(10) Patent No.: US 6,347,213 B1
(45) Date of Patent: Feb. 12, 2002

(54) AUTOMATIC ORIGINAL DOCUMENT CONVEYING APPARATUS AND IMAGE FORMING APPARATUS

(75) Inventors: Yuji Yamanaka, Moriya-machi; Michiro Koike, Kashiwa; Hitoshi Fujimoto, Toride; Kenichi Manabe, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/501,601

(22) Filed: Feb. 10, 2000

(30) Foreign Application Priority Data

Feb. 12, 1999 (JP) ..... 11-034710

(51) Int. Cl.[7] ..... G03G 15/00
(52) U.S. Cl. ..... 399/367
(58) Field of Search ..... 399/365, 367, 399/380; 271/3.01, 3.14, 7

(56) References Cited

U.S. PATENT DOCUMENTS 5,220,393 A * 6/1993 Otomo ..... 399/125
5,878,318 A * 3/1999 Sako et al. ..... 399/367
6,027,109 A * 2/2000 Wada et al. ..... 271/3.14

FOREIGN PATENT DOCUMENTS

| | | |
|---|---|---|
| JP | 56-153346 | * 11/1981 |
| JP | 57-073754 | * 5/1982 |
| JP | 06-255822 | * 9/1994 |

* cited by examiner

*Primary Examiner*—Robert Beatty
(74) *Attorney, Agent, or Firm*—Fitzpatrick, Cella, Harper & Scinto

(57) ABSTRACT

An automatic original document conveying apparatus conveys a placed original document to a prescribed position and delivers the original document. The automatic original document conveying apparatus includes a resin frame, an original document feeding unit for sequentially feeding an original placed document, an original document delivering unit for delivering the fed original document and a metal support plate thereof. The metal support plate securely connects in a united body the resin frame, the original document feeding unit and the original document delivering unit so as to maintain respective relative assembled positions of the units.

16 Claims, 28 Drawing Sheets

AUTOMATIC ORIGINAL DOCUMENT CONVEYING APPARATUS AND IMAGE FORMING APPARATUS

FIELD OF THE INVENTION

This invention relates to an automatic original document conveying apparatus for conveying original documents to a prescribed position and delivering the original documents and to an image forming apparatus having the automatic original document conveying apparatus.

DESCRIPTION OF RELATED ART

Photocopiers and scanners produced currently typically include an automatic original document feeder (ADF) or conveying apparatus for separately feeding original documents automatically sheet by sheet where the original documents in a plural number are set. With such an automatic original document conveying apparatus, original documents are set on an original document tray, and the original documents are separately fed sheet by sheet at an original document feeding section and are conveyed to a prescribed position on a platen glass at an original document conveying section constituted of a conveyance belt, and then, the original document images are read by an image reader. The original document after images are read is conveyed to an original document delivery section by the conveyance belt and is delivered to, e.g., an original document delivery tray at the original document delivery section.

Such an automatic original document conveying apparatus is formed with a metal frame supported in capable of standing and falling down through a hinge unit placed at a top of the photocopier body. The respective structural members for conveying original documents are attached to the frame, and the frame is covered with a housing made of a synthetic resin.

However, with the above structure, since the weight of the automatic original document conveying apparatus becomes excessive when made standing and falling down, a strong spring durable against the weight is required when the hinge unit incorporates a free stopping mechanism, so that the hinge unit is made larger to inevitably make the whole apparatus larger and heavier.

This invention is conceived in a view to the above problems. It is an object of the invention to provide an automatic original document conveying apparatus capable of rendering the whole apparatus smaller and lighter and improving controllability of pivotal movements and an image forming apparatus including the automatic original document conveying apparatus.

SUMMARY OF THE INVENTION

A representative structure of the invention to accomplish the above objects is to structure an automatic original document conveying apparatus including an original document feeding unit for sequentially feeding at least an original document set, an original document delivering unit for delivering the fed original document, and a support plate for securely connecting in a united body the original document feeding unit, the original document conveying unit, and the original document delivering unit as to maintain the respective relative positions.

With the above automatic original document conveying apparatus, at least the original document feeding unit, and the original document delivering unit are secured so as to maintain the respective relative positions by attaching the units to the support plate having a strong rigidity, and since the original documents can be conveyed without bending the original document, the information on the original document can be read surely.

With the automatic original document conveying apparatus, the whole apparatus can be made smaller and lighter without elevating the rigidity of the frame of the whole automatic original document conveying apparatus, as of the conventional apparatus, to make sure the relative assembling positions of those units.

In such an automatic original document conveying apparatus, the original document conveying unit can further be mounted to the support plate, and the support plate can be secured to the original document mounting unit.

Such an automatic original document conveying apparatus makes easier grounding of the respective units by securely connecting the original document feeding unit and the original document delivering unit with the ground level in use of the conductive support plate.

Moreover, where the support plate is made of a metal plate, the plate can keep the rigidity and conductivity easily, so that the automatic original document conveying apparatus can be formed with lower manufacturing costs and a simpler structure.

BRIEF DESCRIPTION OF THE DRAWINGS

FIG. 10 is an exploded perspective illustration showing respective units of the original document feeding section, the original document delivering section, and the like;

FIG. 16(*a*) is an illustration showing a feeding inside guide member and a conveyance belt when seen in a direction perpendicular to the original document conveyance direction; FIG. 16(*b*) is an illustration showing the feeding inside guide member, whose ends are pivotally attached, and the conveyance belt when seen in the original document conveyance direction;

FIG. 17(*a*) is an illustration showing the apparatus front side of the conveyance belt and the feeding inside guide member; FIG. 17(*b*) is an illustration showing a rear side of the apparatus.

DESCRIPTION OF PREFERRED EMBODIMENTS

Figure 1:
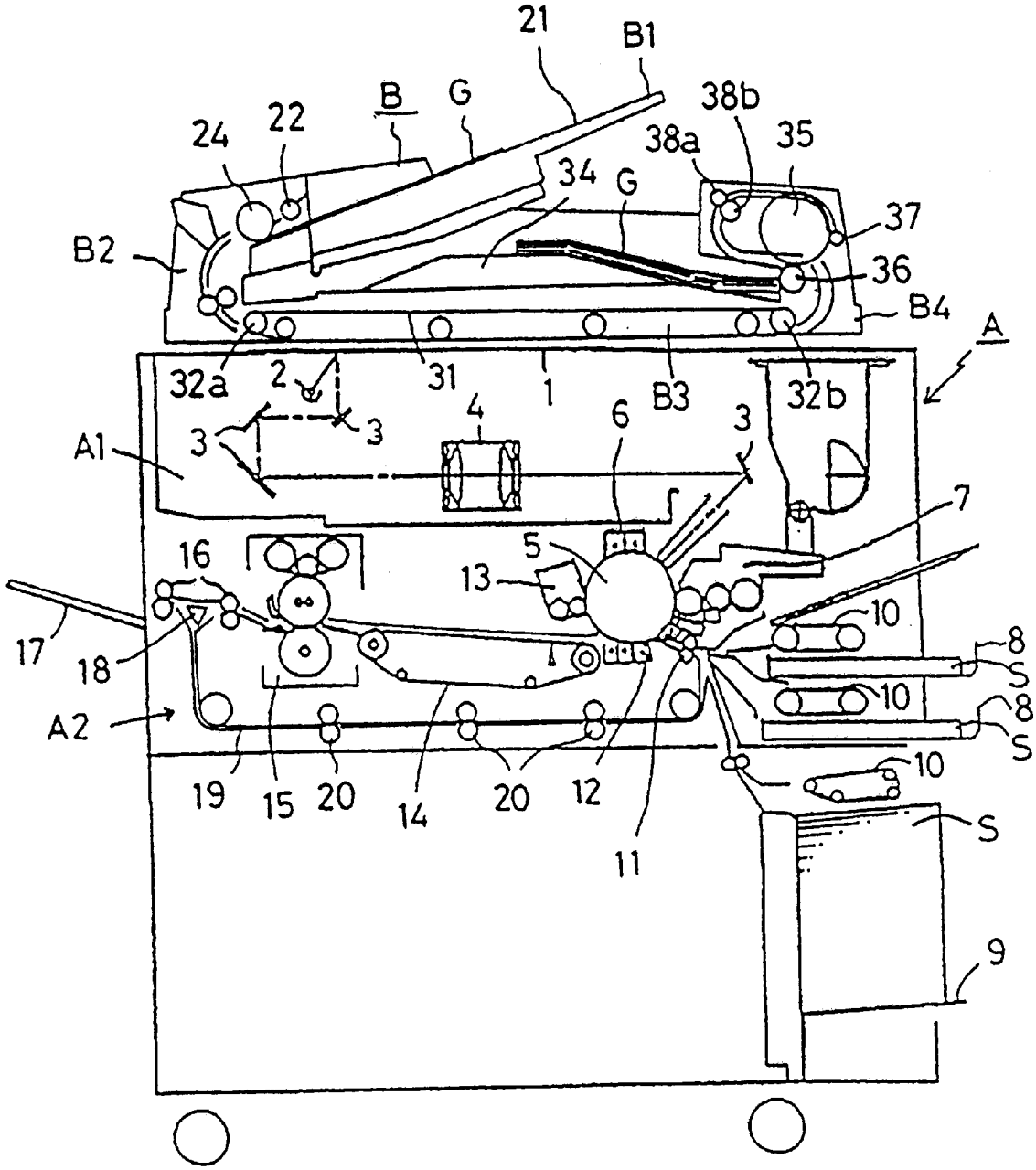
FIG. 1 is an illustration of an inner structure of a photocopier as an example of an image forming apparatus to which an automatic original document conveying apparatus is mounted.

Now, referring to the drawings, an image forming apparatus having an automatic original document conveying apparatus according to the embodiment of the invention is described specifically.

FIG. 1 is an illustration of an inner structure of a photocopier as an example of an image forming apparatus to which an automatic original document conveying apparatus is mounted. This photocopier has a structure that an automatic original document conveying apparatus B is connected on an image forming apparatus A.

Herein, the whole structure of the image forming apparatus is described first, and then, the automatic original document conveying apparatus is described.

[The Whole Structure of the Image Forming Apparatus]

The image forming apparatus body A has a reading apparatus A1 and a recording apparatus A2 as a united body. The reading apparatus A1 reads data upon sequential conveyance of plural sheets of the original documents set at the automatic original document conveying apparatus B, and the recording apparatus A2 makes recordings on recording media such as plain paper or OHP sheets according to the read information.

The reading apparatus A1 makes image exposures on a photosensitive drum by light reflected upon light radiation from a light source 2 through a mirror 3 and lenses 4, with respect to an original document G conveyed to a prescribed position on a platen glass 1 by the automatic original document conveying apparatus B as described below.

The recording apparatus A2 makes image recordings on a recording medium S with an electrophotographic method according to the image exposure made at the recording apparatus A1. A specific structure of the image forming means includes the steps of uniformly charging with a primary charger 6 the surface of the rotatively driving photosensitive drum, forming latent images on the photosensitive drum 5 by the image exposure, and forming toner images by development with toners from the latent images using a developing means 7.

In synchronism with the formation of the toner images, a recording medium S contained in a detachable sheet cassette 8 or a sheet deck 9 is fed separately sheet by sheet by a feeding belt 10 and is conveyed to an image forming means corresponding to the timing for image formation in correcting obliquely feeding by a register roller 11. Toner images formed on the photosensitive drum 5 are transferred by biasing a transfer charger 12 to the recording medium S conveyed between the photosensitive drum 5 and the transfer charger 12, thereby forming the images. The toners remained on the photosensitive drum 5 after the toner image transfer are removed by a cleaning means 13.

The recording medium S to which the toner images are thus transferred is conveyed by a conveyance belt 14 to a fixing means 15, at which the toner images are fixed by application of heat and pressure, and the recording sheets are delivered to a sheet delivery tray 17 by a delivery roller 16.

It is to be noted that the recording apparatus A2 according to this embodiment has a function to make recordings on double sides. To make recording on double sides of the recording medium S, the recording medium S on either side of which is thus recorded is conveyed to a re-feeding path 19 by switching a delivery flapper 18; after switch-backed at the re-feeding path 19, the recording medium is conveyed by a re-feeding roller 20 to the image forming means again to make recording on the other side and then to be delivered on the sheet delivery tray 17.

[Automatic Original Document Conveying Apparatus]

A structure of the automatic original document conveying apparatus B for conveying the original documents G by the reading apparatus A1 to the reading position and delivering the original documents G to the delivery section after reading operation.

Figure 2:
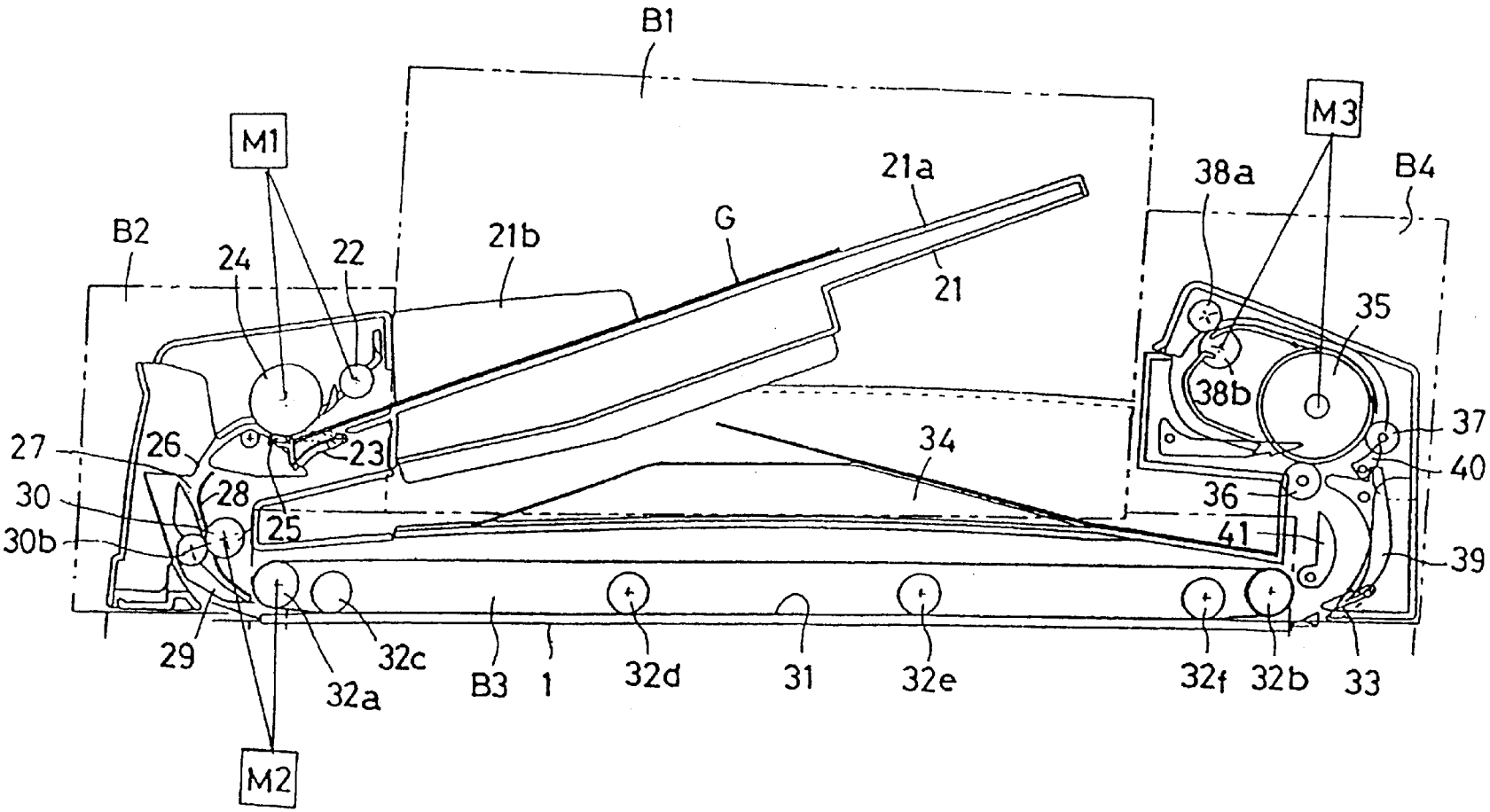
FIG. 2 is a main cross-sectional illustration showing an automatic original document conveying apparatus.
Figure 3:
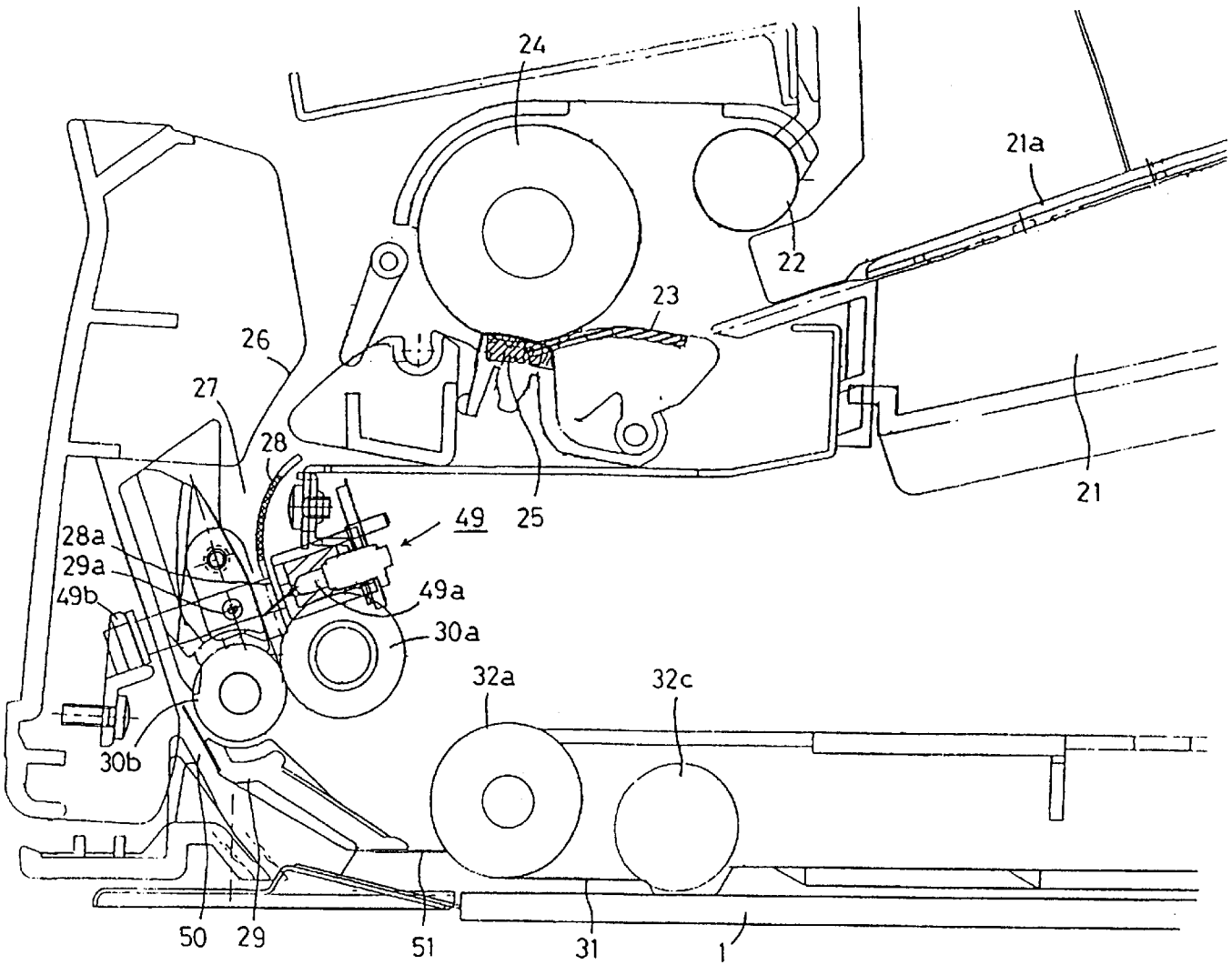
FIG. 3 is an enlarged cross-section of an original document feeding section.
Figure 4:
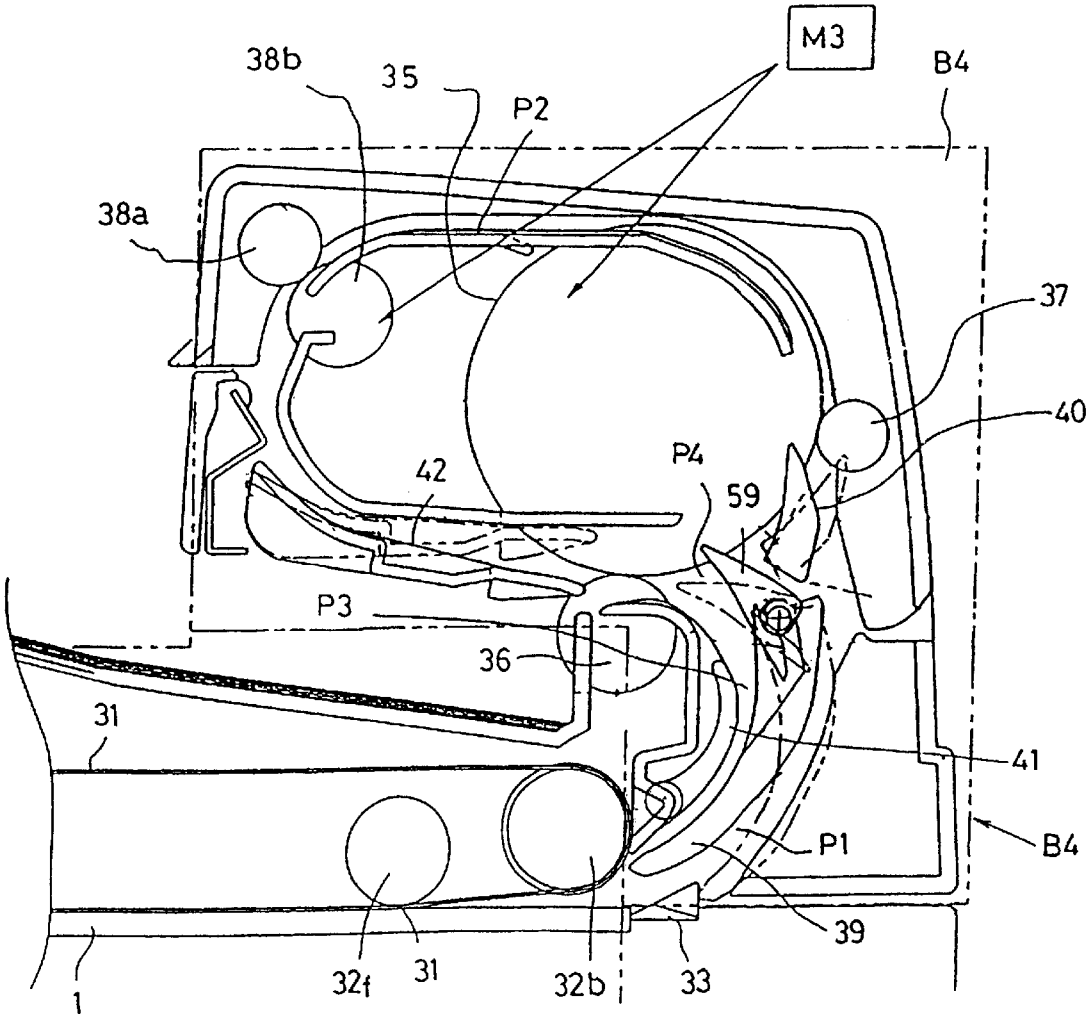
FIG. 4 is an enlarged cross-section of an original document delivering section.

FIG. 2 is a main cross-sectional illustration showing an automatic original document conveying apparatus. The automatic original document conveying apparatus B has an original document mounting section B1, an original document feeding section B2, an original document conveying section B3, and an original document delivering section B4. FIG. 3 is an enlarged cross-section of the original document feeding section; FIG. 4 is an enlarged cross-section of the original document delivering section.

{The Whole Structure of the Automatic Original Document Conveying Apparatus]

(Original Document Feeding Section)

The original document mounting section B1 is to set a bundle of the original documents G in making the document face up on a mounting surface 21*a* of an original document mounting tray 21. The original document mounting section B1 guides the set original documents G by hitting each edge of the original documents G to each side guide 21*b*.

The original document feeding section B2, as shown in FIG. 2 and FIG. 3, the original documents G of plural sheets set on the original document mounting tray 21 are separated sheet by sheet from the topmost sheet and fed by means of the register roller pair.

A pickup roller 22 is attached to be capable of rocking vertically with an up and down mechanism not shown. When the original document is fed, the pickup roller 22 goes down onto the original document bundle, and an intermediate plate 23 moves up to push the original document bundle to a feeding roller 24, at an entry stage of the preliminary feeding operation.

Subsequently, the motor M1 as a drive source rotates the feeding roller 24 and the pickup roller 22 to feed the original document G. The original documents G of the second sheet or later which tend to be dragged by the topmost sheet are stopped at the original document mounting tray 21 by stopping sheet movements with a frictional piece 25. Subsequently, the original documents G are guided by a guide member 26, passes through a feeding guide member 28 and a feeding inside guide member 29, which are constituting the feeding path 27, and introduced to a register roller pair 30*a,* 30*b.* The register roller pair 30*a,* 30*b* are stopped when the front end of the original document reaches there, and the original document is fed to the original document conveying section B3 after corrected as not to be fed obliquely in forming a loop by conveyance with the feeding roller 24.

(Original Document Conveying Section)

The original document conveying section B2 is so structured that a conveyance belt 31 is tensioned with a drive roller 32*a* and a driven roller 32*b* and pressed by belt pressing rollers 32*c,* 32*d,* 32*e,* 32*f* to the platen glass 1. The drive roller 32 receives rotation from a motor M2 as a drive source, thereby rotatively driving the conveyance belt 31. This rotation makes the original document G enter between the plate glass 1 and the conveyance belt 31, and friction force of the conveyance belt 31 conveys the original document on the platen glass 1. The original document G thus conveyed to a prescribed position on the platen glass 1 by the conveyance belt 31 is stopped according to stop motion of the motor M2, and the reading apparatus A1 as described above reads images thereon.

The original document after images are read is conveyed on a right side in FIG. 2 further by the re-driving of the motor M2, and is then guided by a jump piece 33 and conveyed to the original document delivering section B4.

Where an original document in a small size is conveyed, and where a subsequent original document exists, the original document is read by the reading apparatus A1 after the subsequent original document is conveyed to the prescribed position in substantially the same manner as the proceeding original document by rotation of the conveyance belt 31. The proceeding original document during this reading is reversed in sides at the original document delivering section B4 and delivered to the original document delivering tray 34.

(Original Document Delivering Section)

The original document delivering section B4 is to reverse and deliver the original documents G after read. As shown in FIG. 2 and FIG. 4, a driven roller 36 and a driven roller 37 are in pressed contact with a reverse roller 35, and a conveyance roller pair 38*a,* 38*b* is placed in a reverse path P2.

At the original document delivering section B4, respective flappers, a rocking flapper 39, an engagement flapper 40, and a following flapper 41, and a rocking guide 42 are formed to feed the original document to the introduction path P1 or the delivery path P3 during delivery.

The original document delivering section B4 in this embodiment has, according to the side of the original document, a small size original document delivery mode, a large size original document delivery mode, and a double side reading delivery mode in which the double sides of the original document are read. According to the respective modes, the reverse roller 35, the respective flappers 39 to 41, and the rocking guide 42 operate.

(Original Document Delivery Mode)

Figure 8:
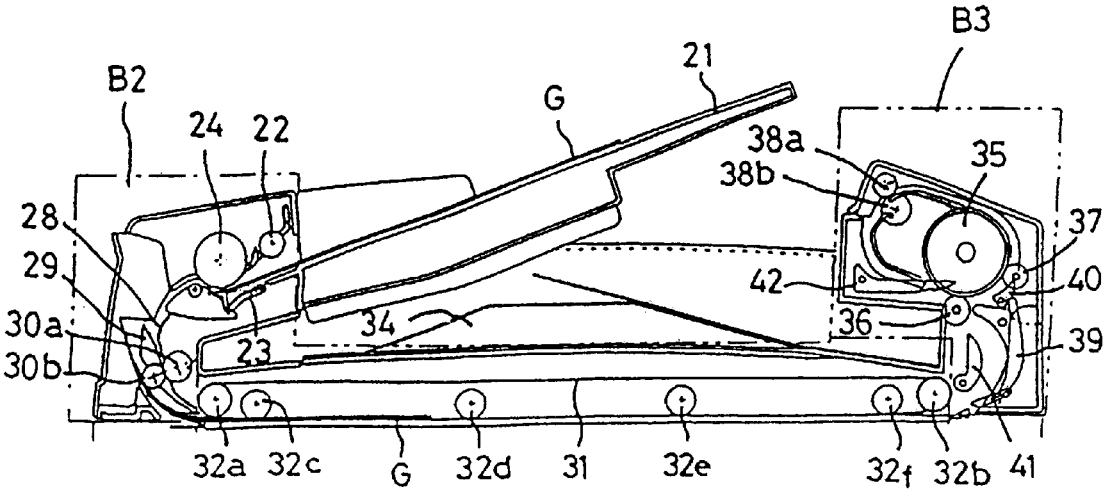
FIG. 8 is an illustration showing a double side reading delivery mode.

Herein, delivery states according to the respective delivery modes are briefly described. It is to be noted that FIGS. 5(*a*) and 5(*b*) and FIGS. 6(*a*) through 6(*d*) are illustrations for the small size original document delivery mode, and that FIGS. 7(*a*) through 7(*d*) are an illustration for the large size original document delivery mode, and FIG. 8 is an illustration for double side reading delivery mode.

Figure 5A:
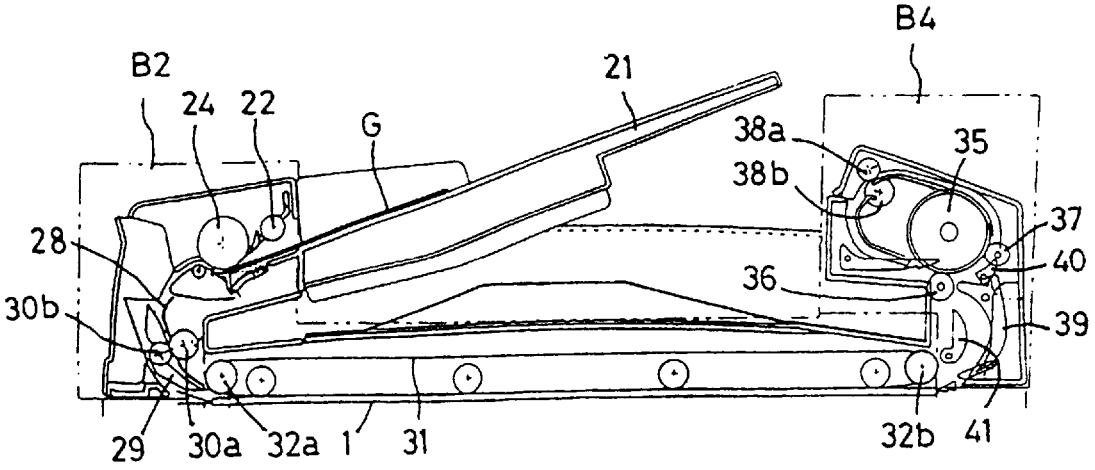
FIGS. 5(*a*) and 5(*b*) are illustrations showing a small size original document delivery mode.
Figure 5B:
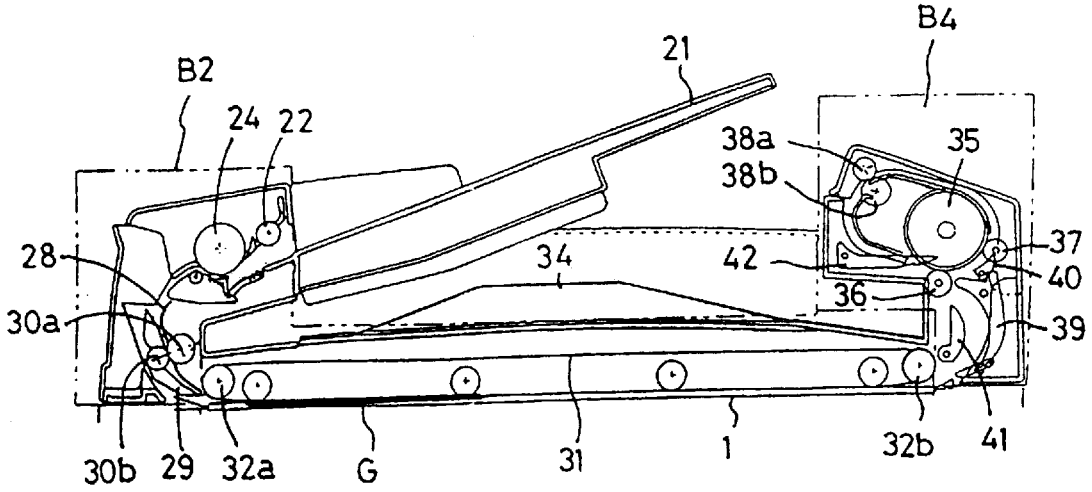
Figure 6A:
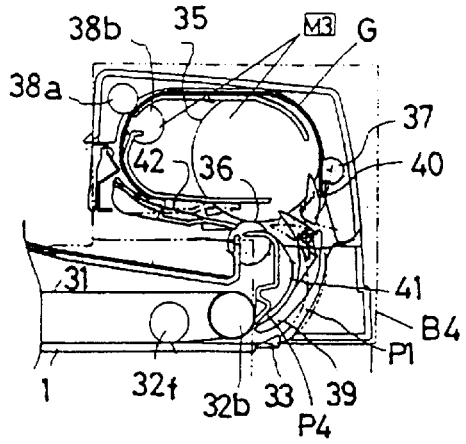
FIGS. 6(*a*), 6(*b*), 6(*c*), and 6(*d*) are illustrations showing a small size original document delivery mode.
Figure 6B:
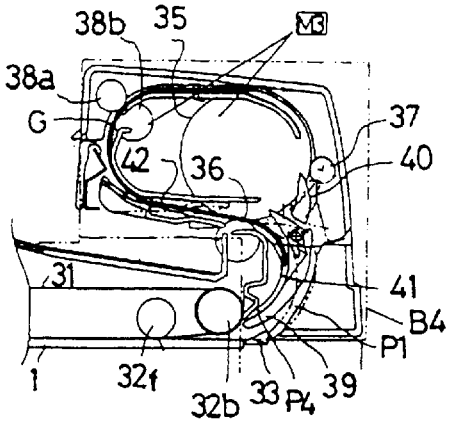
Figure 6C:
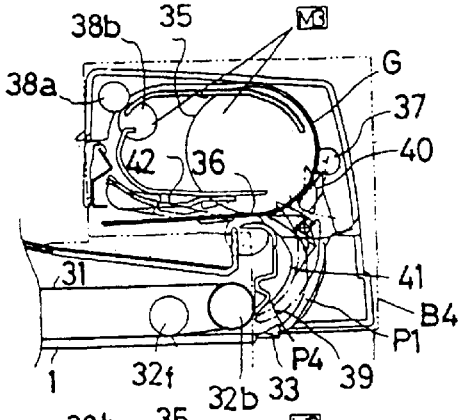
Figure 6D:
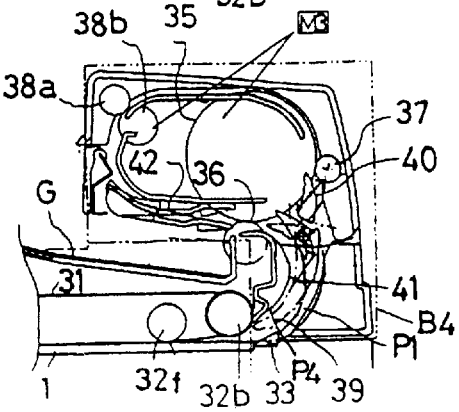
Figure 7A:
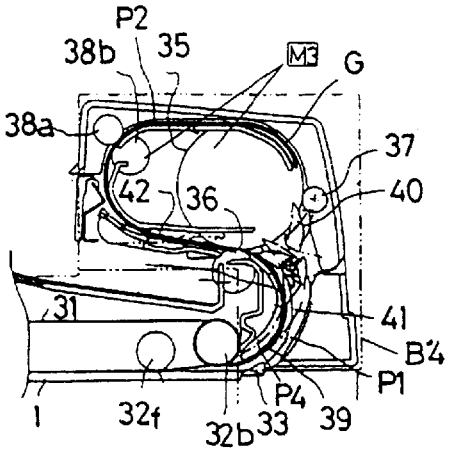
FIGS. 7(*a*), 7(*b*), 7(*c*), and 7(*d*) are illustrations showing a large size original document delivery mode.
Figure 7B:
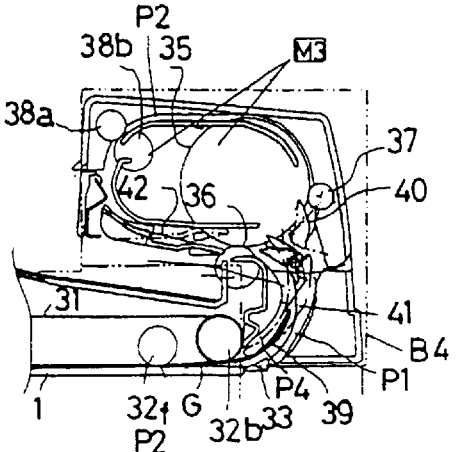
Figure 7C:
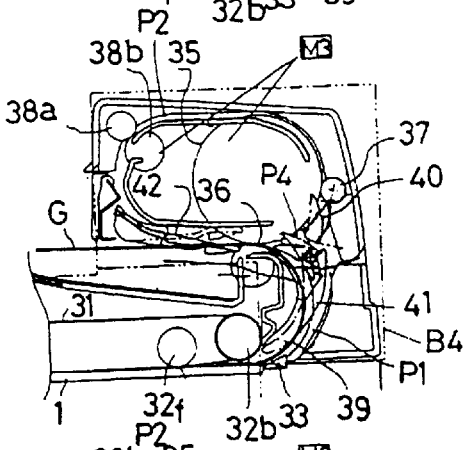
Figure 7D:
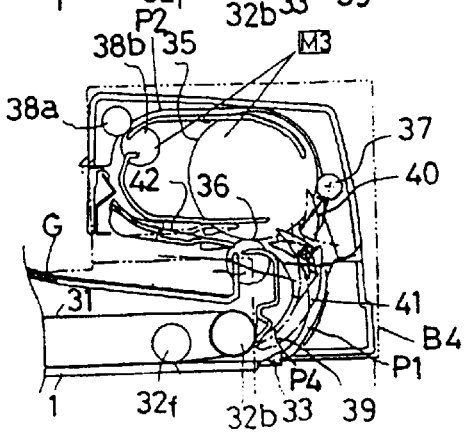

In a case of the small size original document delivery mode, as shown in FIGS. 5(*a*) and 5(*b*), and FIGS. 6(*a*) through (6(*d*), a small size original document G (see, FIG. 5(*a*)) on the original document mounting tray 21 is fed at the original document feeding section B2 (see, FIG. 5(*b*)); conveyed by the conveyance belt 31 to the prescribed position on the platen glass 1; and subject to reading. The original document G is sent to the introduction path P1 of the original document delivering section B4 by the conveyance belt 31, as well as sent to the reverse path P2 by normal drive (in a counterclockwise direction in FIGS. 6(*a*) through 6(*d*) of the reverse roller 35 (FIG. 6(*a*)), and sent midway of the delivery path P3 (FIG. 6(*b*)). At a time that the read end of the original document (on a downstream side in the conveyance direction) enters in the reverse path P2, the reverse roller 35 is reverse driven (in a clockwise direction in FIGS. 6(*a*) through 6(*d*), and the flappers 39 to 41, and the rocking guide 42 are switched, thereby switching back the original document G. The original document G is delivered to the original document delivering tray 34 between the reverse roller 35 and the driven roller 36 through the conveyance path P4 (see, FIGS. 6(*c*), through 6(*d*). At that time, the delivered original document G faces down, and the delivery done in such a manner makes the original documents G successively delivered and stacked to be in the order of the page number.

In a case of the large size original document delivery mode, as shown in FIGS. 7(*a*) through 7(*d*), a large size original document which is read at the prescribed position on the platen glass 1 is conveyed to the original document delivery section B4, and sent to the delivery path P3 through the introduction path P1 and the reverse path P2 (FIG. 7(*a*)). The original document G is re-conveyed onto the platen glass 1 by normal rotation of the reverse roller 35 and reverse drive of the conveyance belt 31 (FIG. 7(*b*)). At that time, the original document faces up. Subsequently, the flappers 39 to 41, and the rocking guide 42 are switched; the conveyance belt 41 is normally driven; and the reverse roller is reverse driven, thereby switching back the original document G to delivery the original document G to the original document delivering tray 34 through the delivery path P3 between the reverse roller 35 and the driven roller 36 (FIG. 7(*c*) and FIG. 7(*d*)). At that time, the delivered original document G faces down, and the original documents G are successively delivered and stacked to be in the order of the page number in substantially the same manner as the small size original document.

In a case of the double side reading delivery mode, notwithstanding of the small size or large size original documents, the original document whose one side is read is made to pass in substantially the same manner as the case of the large size original document as described above through the introduction path P1, the reverse path P2, and the delivery path P3, in this order, and conveyed onto the platen glass 1 (states in FIGS. 7(*a*), 7(*b*)). At that time, the original document G is in a state that the unread side of the original document faces down. The original document G in this state is conveyed to the prescribed position of the original document feeding section B2 as shown in FIG. 8 by further reverse driving of the conveyance belt 31. The conveyance belt 31 is normally driven again to convey the original document G to the prescribed position, and the other side of the original document is read. The original document is then delivered to the original document delivering tray 34 through the delivery path P3 of the original document delivering section B4 between the reverse roller 35 and the driven roller 36 (states in FIGS. 7(*c*), 7(*d*)).

Figure 9:
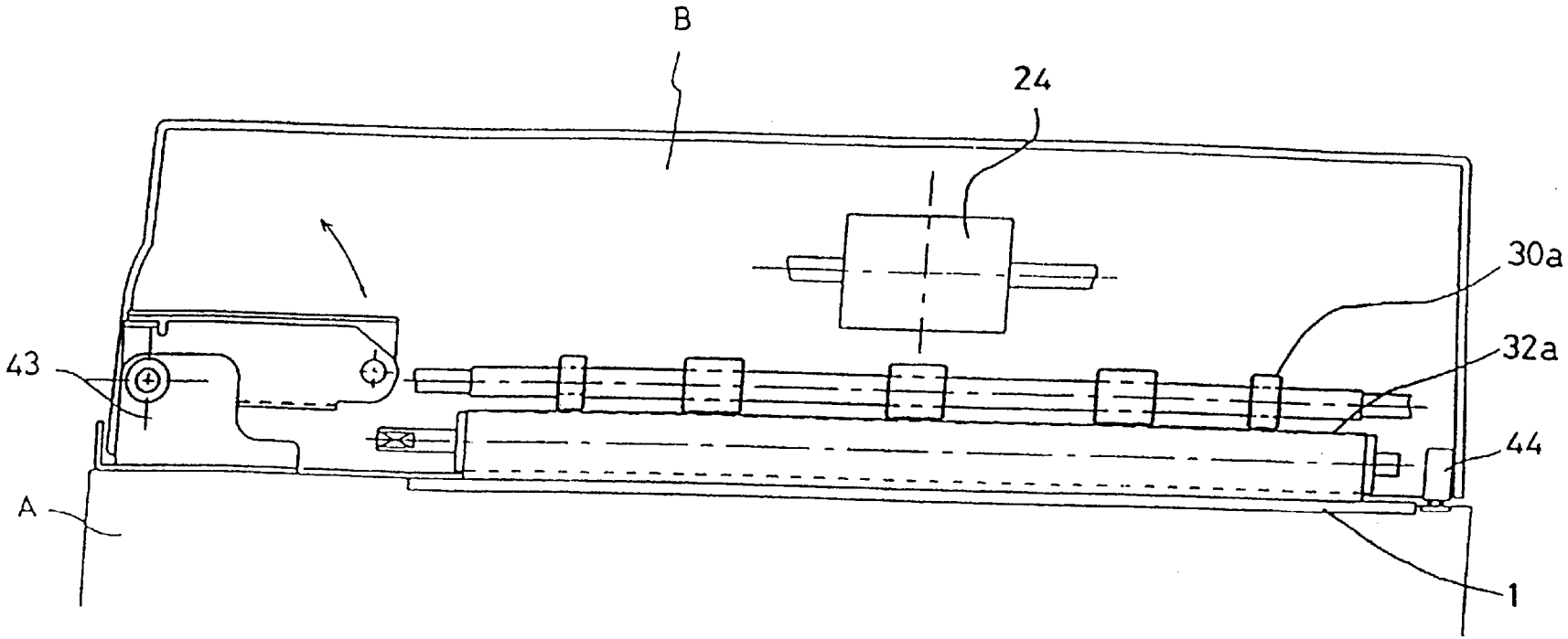
FIG. 9 is a side cross-section showing the automatic original document conveying apparatus.

The automatic original document conveying apparatus B is attached as to cover the top of the platen glass 1 formed at a top of the image forming apparatus body A. As shown in FIG. 9 (side cross section of an automatic original document conveying apparatus), the rear side of the automatic original document conveying apparatus (on a left side of FIG. 9) is connected to the image forming apparatus body by a hinge unit, and the front side (on a right side of FIG. 9) is detachably attached to the image forming apparatus body by, e.g., a magnet catcher 44. Structural features of the respective portions of the automatic original document conveying apparatus B are described sequentially next.

{Supporting Structure of the Respective Units}

Figure 10:
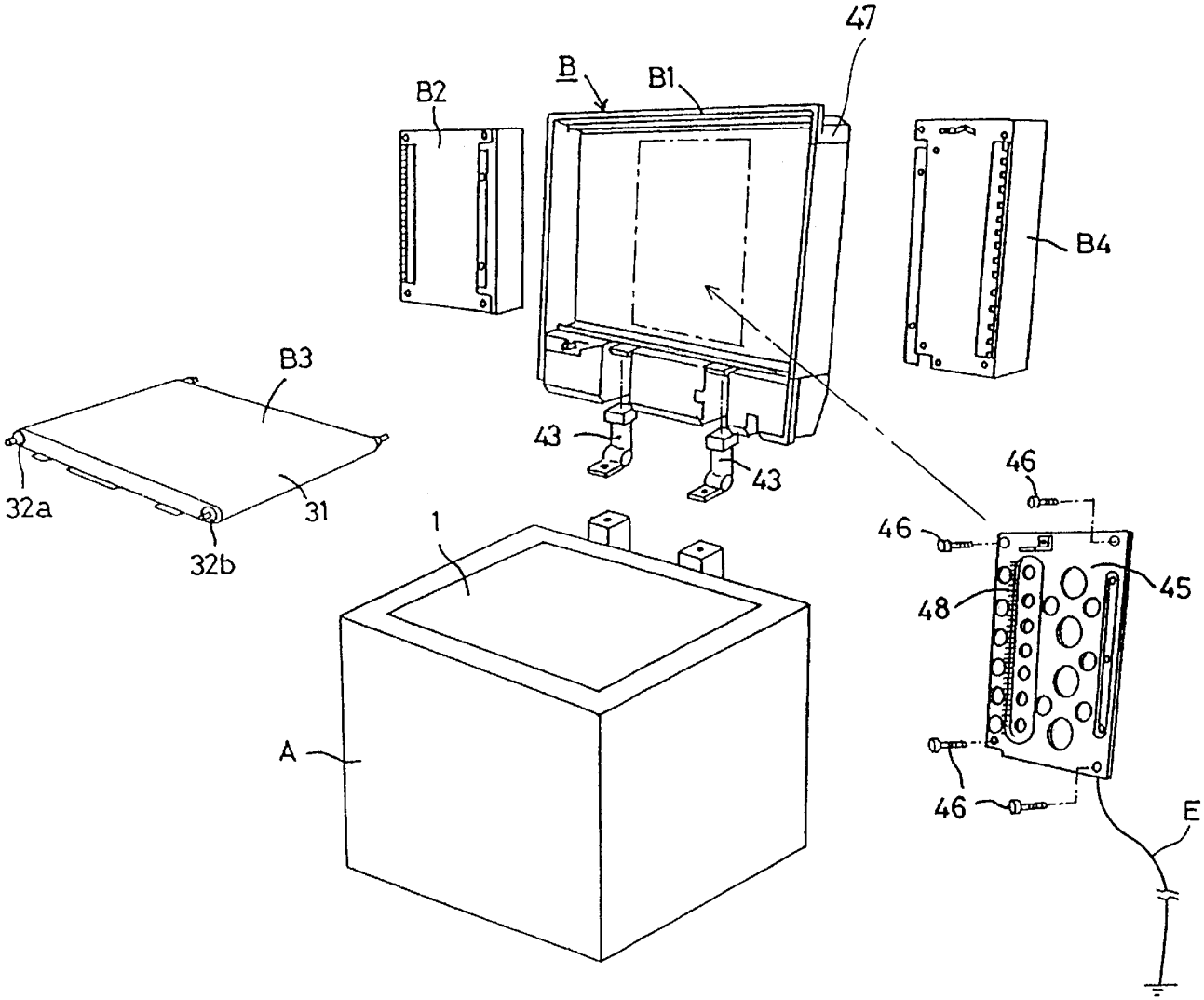

The automatic original document conveying apparatus B according to this embodiment is, as described above, constituted of the original document mounting section B1, the original document feeding section B2, the original document conveying section B3, and the original document delivering section B4, as the respective units. As shown in FIG. 10, the respective units are structured to be assembled to the image forming apparatus body A by a hinge unit 43 in connecting the respective unit with the hinge unit.

Herein, a conventional automatic original document conveying apparatus has a metal frame supported to be capable of standing and falling down by the hinge unit on a top of the photocopier, and a structure member for conveying the original documents is attached to the frame. The structural member is covered by a housing made of a synthetic resin. Since the weight when falling down and standing becomes excessive, a strong spring durable against the weight is required when the hinge unit incorporates a free stopping mechanism, so that the hinge unit is made larger to inevitably make the whole apparatus larger and heavier.

Figure 11:
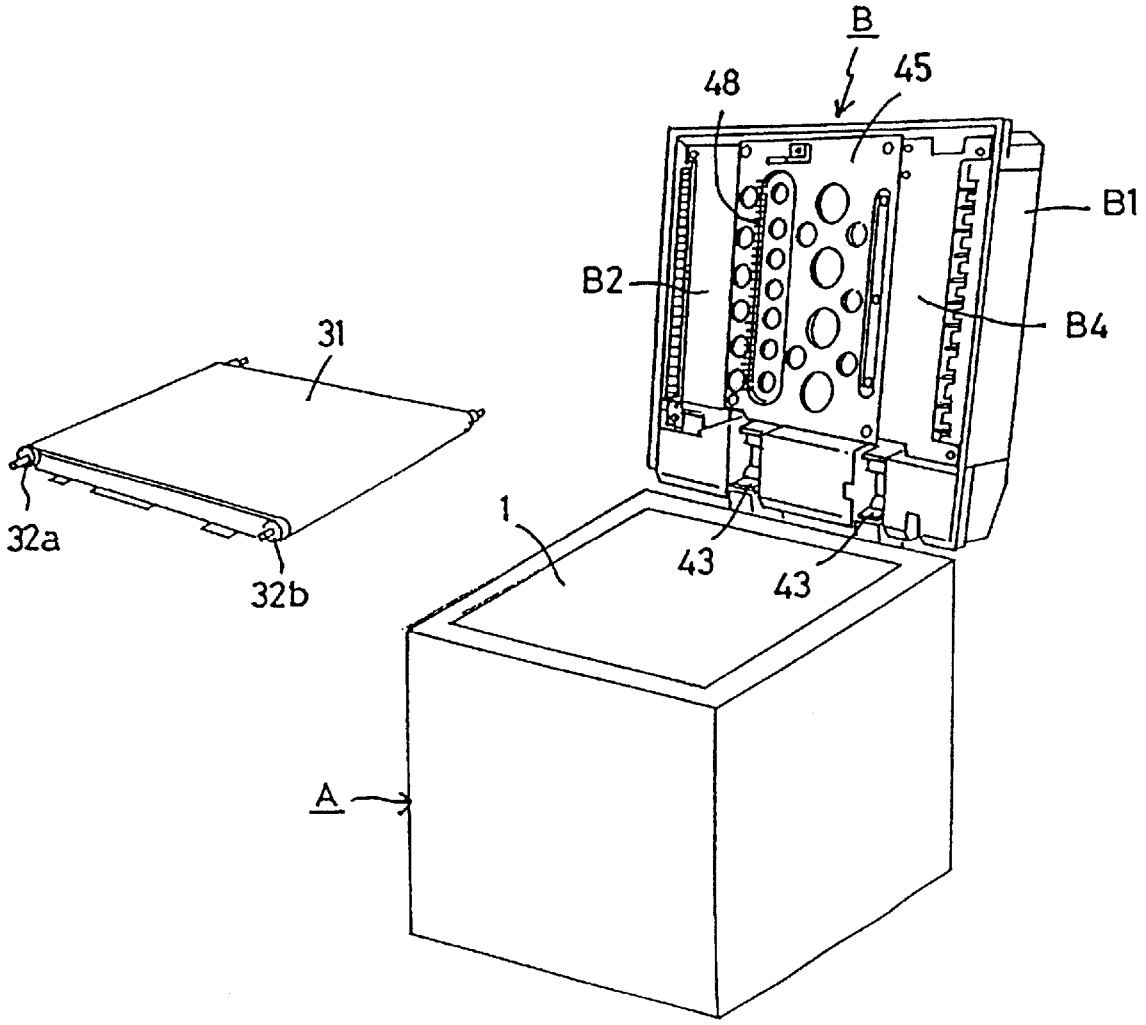
FIG. 11 is an illustration showing a state that a support plate securely connects the respective units such as the original document feeding section, the original document delivering section, and the like to the plate.

In this embodiment, as shown in FIGS. 10, 11, a support plate 45 made of a metal plate is used. The support plate 45 connects the original document feeding section B2, the original document delivering section B4, and the hinge unit 43, which serve as units, by screws 46 or the like, and the support plate 45 is attached to a monocoque frame 47 made of a synthetic resin in a united body with the original document mounting section B1.

The original document conveying section B3 is attached to a predetermined position of the support plate 45, thereby determining surely relative assembling positions of the original document feeding section B2, the original document conveying section B3, the original document delivering section B4. The original document G is thus conveyed among the respective units without being subjected to warping, so that the original document information can be read accurately during reading of the original documents.

The support plate 45 is formed with embossments and lighter holes by press, so that the support plate 45 has a high rigidity and is made with a lighter weight.

Thus, because the respective units are securely connected by the support plate 45 having a high rigidity, the monocoque frame 45 can be made thinner and can be made more compact since the strength of the monocoque frame 47 is not so required as in the conventional model, so that the handling property and assembling property are improved, and the apparatus can be manufactured with less costs.

Since the respective units are securely connected by the support plate 45 made of a metal plate, the respective units can be connected to the ground level easily by the image forming apparatus body A through the hinge unit 43 from the metal plate. Therefore, in this embodiment, a charge eliminating needle 48 as a charge eliminating member, made of a conductive brush member, is formed at the support plate 45, and when the conveyance belt 31 is assembled, the charge eliminating needle 48 comes in contact with the surface of the conveyance belt 31, so that charges in the conveyance belt 31 can be eliminated surely.

It is to noted that charges collected by the charge eliminating needle 48 can be grounded to a side of the image forming apparatus body A through an earth line E and the hinge unit 43.

{Original Document Detecting Structure}

When the original document is fed by the automatic original document conveying apparatus B thus assembled, a sheet sensor or sheet sensors may be provided to detect the position of the original documents. With this embodiment, a sensor detecting the original document passing plural paths is used commonly to reduce the number of the sensors.

Figure 12:
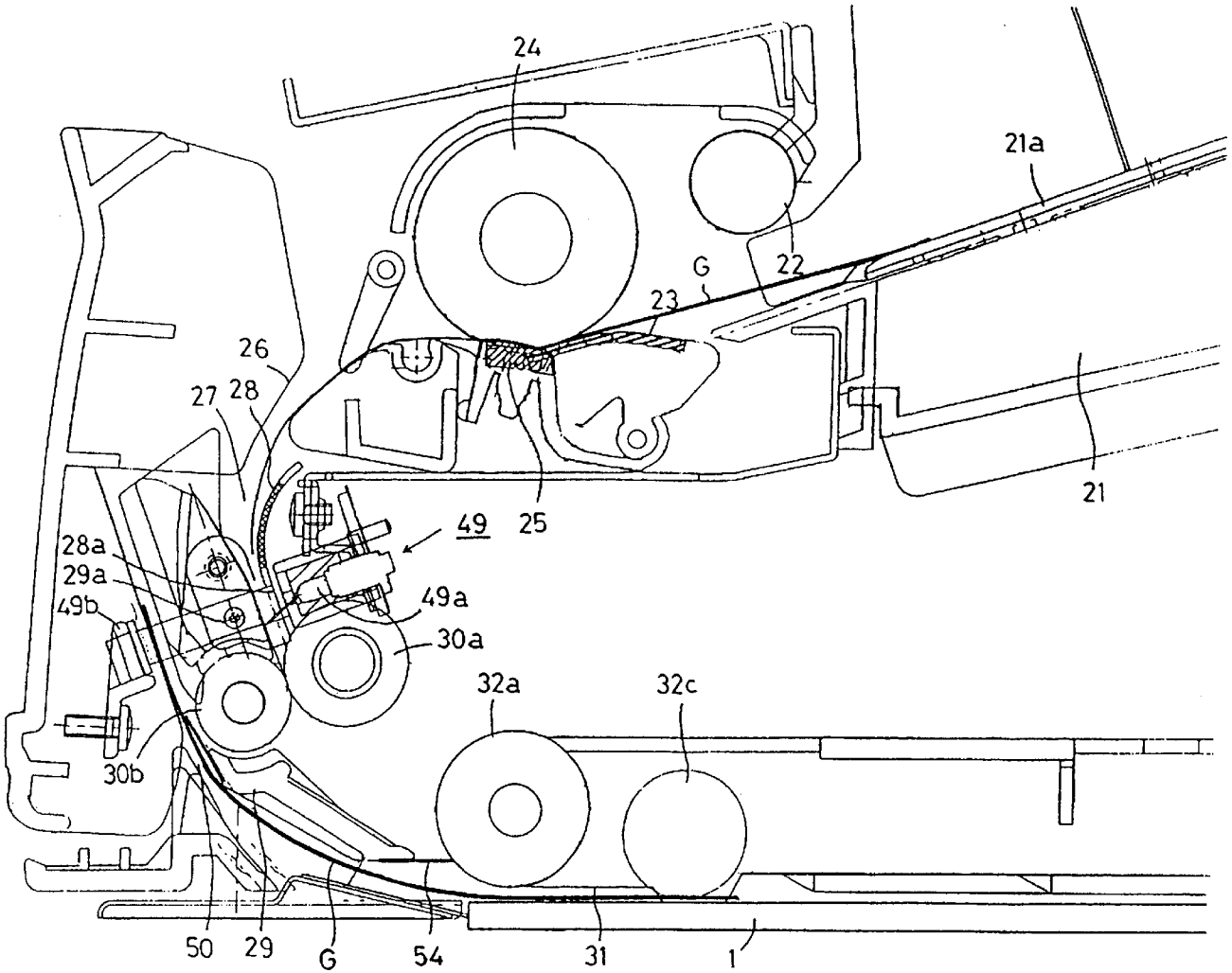
FIG. 12 is an illustration showing a structure detecting an original document passing plural paths by a single sheet sensor in the original document feeding section.

For example, as shown in FIG. 12, the original document G fed from the original document mounting tray 21 at the original document feeding section B2 is, as described above, fed onto the platen glass 1 by the register roller pair 30*a*, 30*b* in passing through the feeding path 27 constituted of the guide members 28, 29, and a sheet sensor 49 is placed to detect the original document G. In this embodiment, a photo sensor made of a light emitting device 49*a* and a light receiving device 49*b* as the sheet sensor 49 is used, and where the original document cuts off the light path of the sensor passing the devices 49*a*, 49*b*, the existence of the original document G is detected.

The light emitting device 49*a* and the light receiving device 49*b* are attached as to oppose to each other astride the guide members 28, 29 constituting the conveyance path 27. The respective guide members 28, 29 have slits 28*a*, 29*a* for forming the light path of the sensor. With this structure, the sensor detects the passage of the original document when the front end of the original document fed on the platen glass 1 after passing the feeding path 27 from the original document mounting tray 21 cuts off the light path of the sheet sensor 49. The register roller pair 30*a*, 30*b* starts rotating, and the original document length can be detected by the rotary amount of the register roller pair 30*a*, 30*b* until the rear end of the fed original document completely passes over the sheet sensor 49.

On the other hand, the original document feeding section B2 conveys back the original document whose one side has been read during the double side reading mode by the reverse rotation of the conveyance belt 31 to the prescribed position of the original document feeding section B2 again (see, FIG. 8). At that time, as shown in FIG. 12, the original document G enters in a double side reverse path 50 constituted of the feeding inside guide member 29 and a guide portion 47*a* of the monocoque frame 47, and when the front end of the original document cuts off the light path of the sheet sensor 49, the sensor 49 detects the original document, and the original document is further conveyed in a prescribed amount and stopped.

That is, the sheet sensor 49 detects both of the original document fed onto the platen glass 1 from the original document mounting tray 21 and the original document sent into the double side reverse path 50 during the double side reading mode.

It is to be noted that the original document can be detected by cutting off the light path of the sheet sensor 49 in any of the cases of the original documents passing through the feeding path 27 and the double side reverse path 50. Where the original document passes through the feeding path 27, the register roller pair 30*a*, 30*b* and the conveyance belt 31 drive in the normal direction, and where the original document passes through the double side reverse path 50, the conveyance belt 31 is driven in the reverse direction, so that the sensor can detect whether the original document is located in the feeding path 27 or the double side reverse path 50 by detecting the drive direction of the drive motor.

Herein, as for feeding of the original documents, to feed the original documents successively from the original document mounting tray 21, the subsequent original document is made to wait upon sending the front end of the subsequent original document to the register roller pair 30*a*, 30*b*, or so called "pre-entry processing" is made, when the proceeding original document is fed onto the platen glass 1. In the double side reverse path 50, the original document may cut off the sensor light path if the original document is located in the feeding path 27 in the double side reading mode, the apparatus cannot detect the original document in the double side reading mode. In this embodiment, during the double side reading mode, the no pre-entry processing is made or the front end of the subsequent original document is made waited at a position not cutting off the sensor light path even where the pre-entry processing is made.

Figure 13:
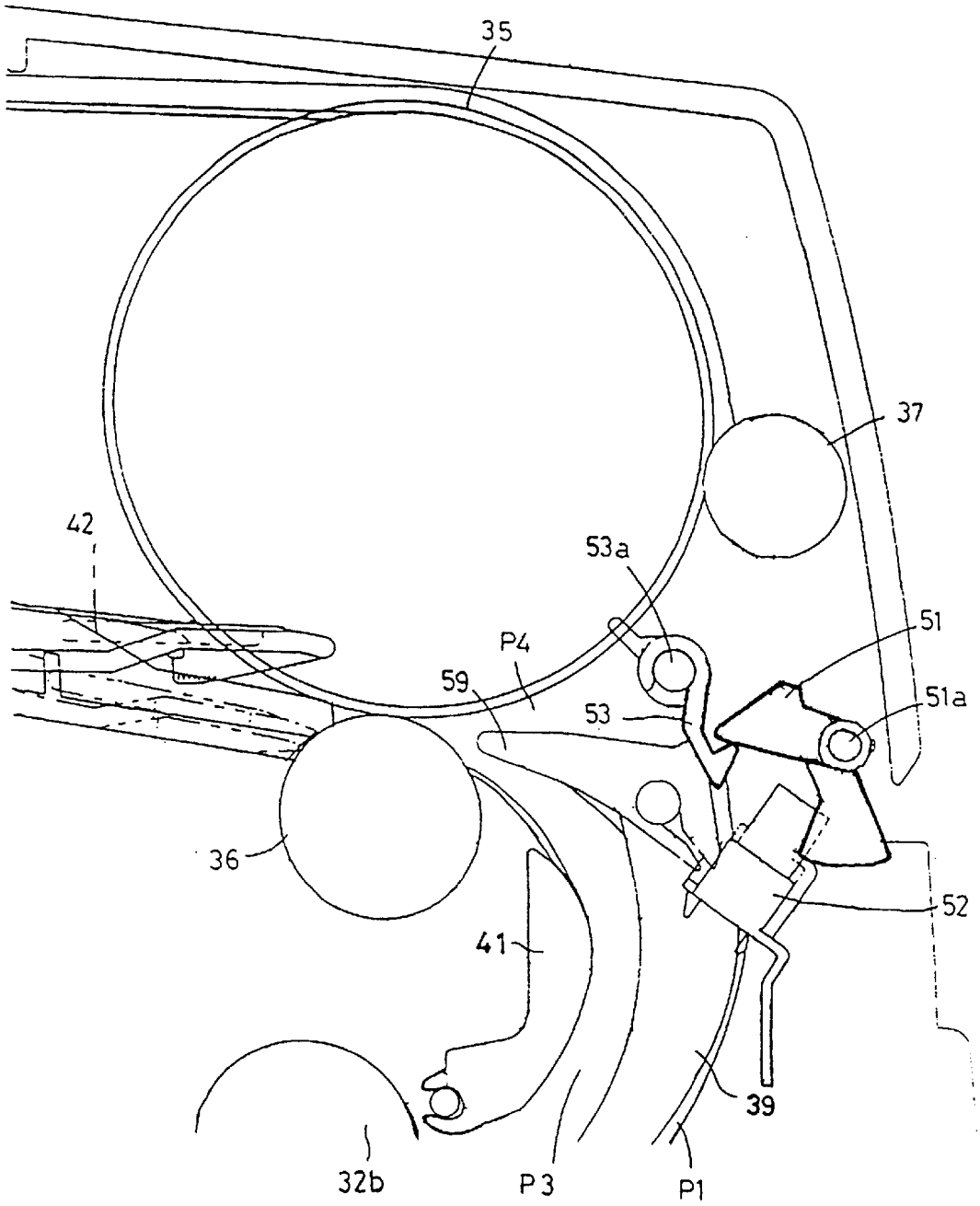
FIG. 13 is an illustration showing a structure detecting an original document passing plural paths by a single sheet sensor in the original document delivering section.
Figure 14:
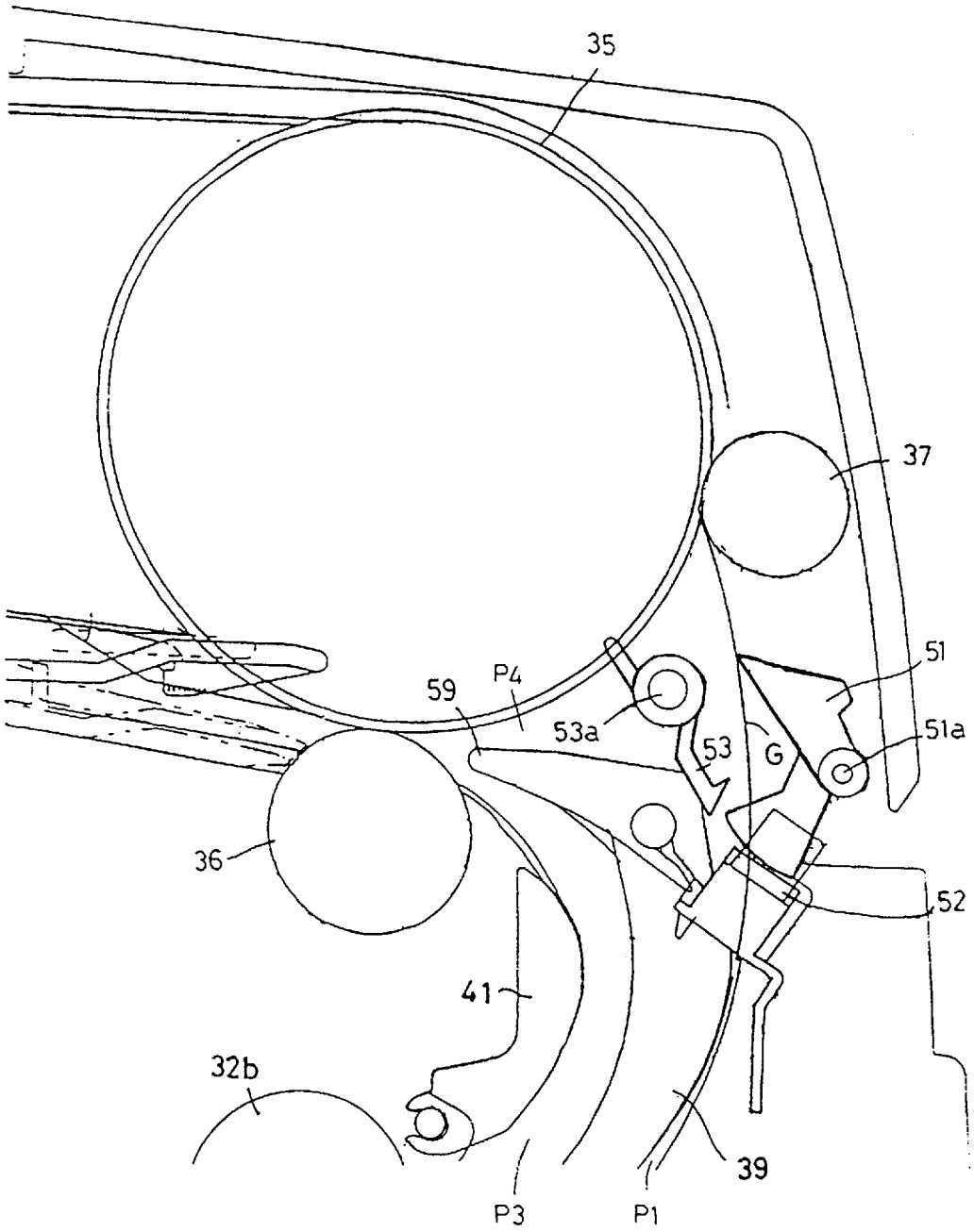
FIG. 14 is an illustration showing a structure detecting an original document passing plural paths by a single sheet sensor in the original document delivering section.

The structure in which a single sensor detects the original document passing through plural paths is also used in the original document delivering section B4 as shown in FIG. 13. In FIG. 13, a first sensor flag 51 is pivotally formed at a middle of the introduction path P1, and the first sensor flag 51 is pushed up by the original document G when the original document G passes through the introduction path P1 as shown in FIG. 14 and rotates around a shaft 51*a* as a center. The original document G passing through the introduction path can be detected because the rotated first sensor flag 51 cuts off the light path of the sheet sensor 52 constituted of the photo sensor.

By detecting the drive amount of the motor upon passing the front end of the original document by the sheet sensor 52, not only existence of the original document but also the conveyance amount of the original document can be controlled.

Figure 15:
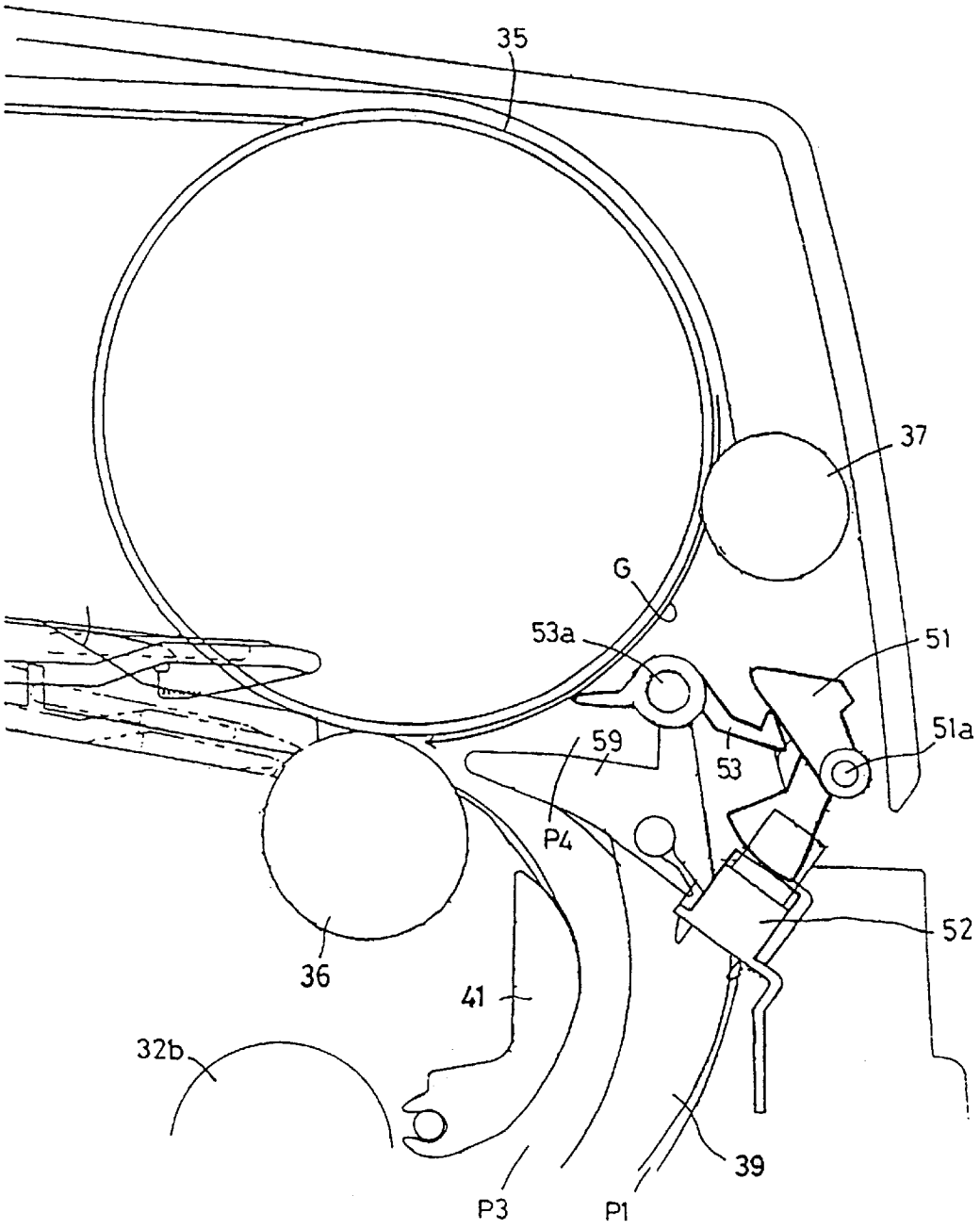
FIG. 15 is an illustration showing a structure detecting an original document passing plural paths by a single sheet sensor in the original document delivering section.

A second sensor flag 53 around the first sensor flag 51 is pivotally attached around a shaft 53*a* as a center. One end of the second sensor flag 53 can push the first sensor flag 51, and the other end projects in a conveyance area of the original documents conveyed by the reverse roller 35. Therefore, as shown in FIG. 15, when the original document G is sent to a nip portion between the reverse roller 35 and the driven roller 36 from the conveyance path P4 by the reverse roller 35, the front end of the original document pushes the second sensor flag 53 as to rotate in the counterclockwise direction. This rotation renders the first sensor flag 51 rotate in the clockwise direction to cut off the light path of the sheet sensor 52, so that the original document G conveyed by the reverse roller 35 can be detected. In this situation, in the same manner as the detection of the original document on the feeding side as described above, the reverse roller 35 normally rotates (in the counterclockwise direction in FIG. 14) when the original document passes through the introduction path P1, and the reverse roller 35 rotates reverse (in the clockwise direction in FIG. 15) when the original document is conveyed to the original document delivering tray 34 from the conveyance path P4 by the reverse roller 35, so that it can be detected which paths the original document G goes by detecting the drive direction of the motor M3 for driving the reverse roller 35.

As described above, since the single sheet sensor detects the original document passing through the plural paths, the number of the sheet sensors can be reduced which conventionally provided for each conveyance path, so that the assembling steps as well as costs can be reduced.

{Positioning Structure of Feeding Inside Guide Member}

As described above, the original document sent onto the platen glass 1 from the original document mounting tray 21 and the original document sent to the double side reverse path 50 during the double side reading mode are guided by the feeding inside guide member 29. Next, a structure for maintaining the space between the feeding inside guide member 29 and the conveyance belt 31 is described. It is to be noted that FIG. 16(*a*) is an illustration showing the feeding inside guide member 29 and the conveyance belt 31 when seen in a direction perpendicular to the original document conveyance direction and FIG. 16(*b*) is an illustration showing the feeding inside guide member 29', whose ends are pivotally attached, and the conveyance belt 31 when seen in the original document conveyance direction.

Figure 16A:
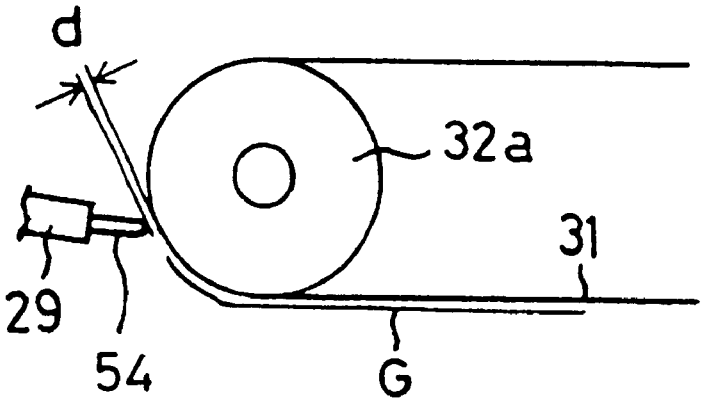
FIGS. 16(*a*), 16(*b*) are cross-sectional illustrations.
Figure 16B:
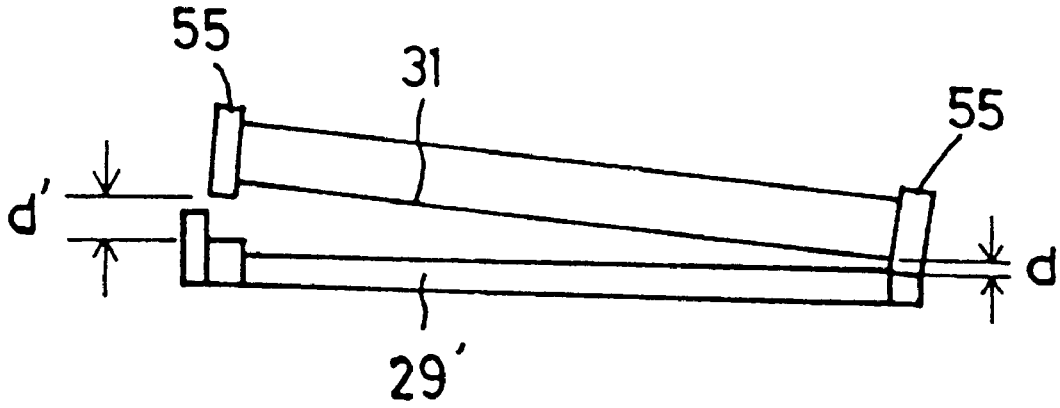

As shown in FIG. 16(*a*), a space d is formed between the front end of the feeding inside guide member 29 and the conveyance belt 31 for allowing feeding of the original document G. If the space becomes larger, the original document returned by the conveyance belt 31 may enter in the feeding path 27 without being introduced into the double side reverse path 50 when the original document G is sent to the double side reverse path 50 during the double side reading operation. To prevent this, a Mylar (trade name) sheet 54 is attached to a tip of the feeding inside guide member 29 to design the space between the tip of the Mylar sheet 54 and the conveyance belt 31 to be very small.

To maintain the space constant, a conventional structure typically had a feeding inside guide member whose opposite ends (opposite ends in a direction perpendicular to the original document conveyance direction) were rotatively attached with a shaft member, and the opposite ends of the tip on a rotation side of the guide member were hit to a belt frame as a support member for supporting the conveyance belt to position the guide member.

However, as shown in FIG. 16(*b*), one side in the rotary shaft direction is structured to be capable of rocking vertically in a certain range to render the conveyance belt 31 in contact even with a small size original document. If one side of the conveyance belt 31 is moved in a rocking manner and inclined with respect to the platen glass 1, the tip of the feeding inside guide member 29' positioned in hitting the belt frame 55, though hitting the belt frame 55 on the one side, enters in a floating state from the belt frame 55 on the other side. Therefore, at the area, the space d' between the conveyance belt 31 and the feeding inside guide member 29' becomes larger, so that the original document returned at the conveyance belt 31 can easily enter in the feeding path 27. This may easily occur where the roller size of the drive roller 32*a* tensioning the conveyance belt 31 for making the apparatus compact is made smaller, where the height of the tip of the feeding inside guide member from the level of the platen glass is made smaller, and where the original document having a tip curled upwardly is conveyed.

Figure 17A:
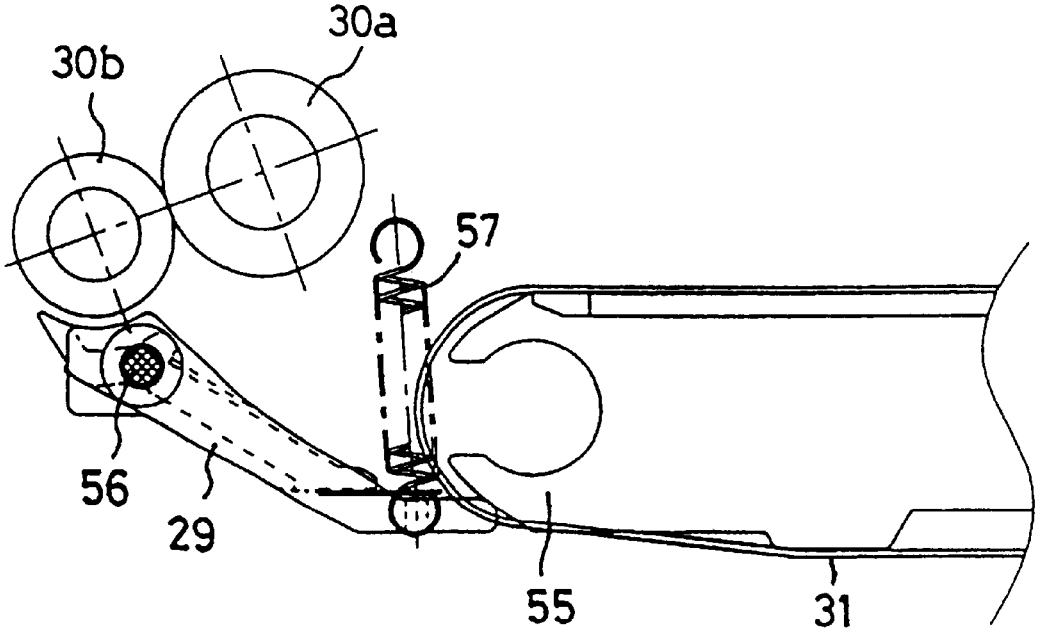
FIGS. 17(*a*) and 17(*b*) are cross sections.
Figure 17B:
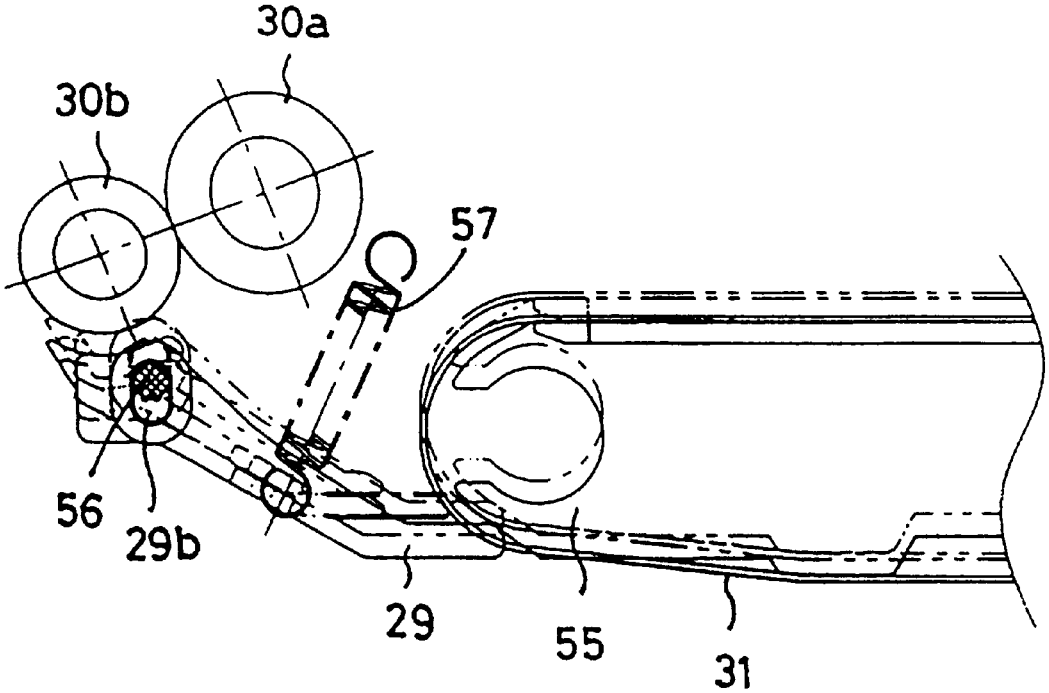

In this embodiment, as shown in FIGS. 17(*a*) and 17(*b*), it is structured that the feeding inside guide member 29' follows rocking motions of the conveyance belt 31. It is to be noted that FIG. 17(*a*) is an illustration showing the apparatus front side of the conveyance belt and the feeding inside guide member, and FIG. 17(*b*) is an illustration showing a rear side of the apparatus. It is to be noted that the conveyance belt 31 has a rotary shaft secured in a vertical direction on the front side of the apparatus but the rotary shaft on the rear side of the apparatus is capable of rocking in the vertical direction.

As shown in FIGS. 17(*a*), 17(*b*), the opposite ends of the feeding inside guide member 29 are attached pivotally around a shaft 56, and a pulling spring 57 is attached on a tip side of the member. The feeding inside guide member 29 is positioned by hitting the opposite ends of the member tip to the belt frame 55 of the conveyance belt 31. The rear end of the feeding inside guide member 29 is attached pivotally with a long hole 29*b* to the shaft 56.

Since the one side of the feeding inside guide member 29 (on a rocking side of the conveyance belt 31) is structured to be pivotally movable with the long hole 29*b*, the feeding inside guide member 29 can move up and down in a rocking manner according to the conveyance belt 31 when the conveyance belt 31 moves up and down in a rocking manner, and the guide member 29 maintains a contact state in which the member 29 is in contact with the belt frame 55 on both of the front and rear sides with respect to the conveyance belt 31. Therefore, the space between the conveyance belt 31 and the tip of the feeding inside guide member is always maintained in a constant amount, so that this prevents the original document from mistakenly entering in the feeding path 27 otherwise to be sent to the double side reverse path 50 during the double side reading mode.

{Rocking Flapper}

The original document delivering section B4 described above reverses the original document G whose images on one side have been read and delivers the original document G to the original document delivery tray 34; reverses the original document G whose images on one side have been read and delivers the original document G to the original document delivery tray 34; or delivers to the original document delivery tray 34 the original document G whose images on the double sides have been read. This original document delivering section B4 is constituted, to operate in the above-mentioned manner, the rocking flapper 39 capable of rocking to switch the sheet paths for guiding the original documents, the following flapper 41 rocking in following the rocking flapper 39, the engagement flapper 40 rocking in association with rocking of the rocking flapper 39 in engagement with the rocking flapper 39, a delivery drive mechanism 58 (see, FIG. 26) for driving the respective portions such as rollers constituting the original document conveying section B4, and the like. Hereinafter, summaries of respective portions constituting the original document conveying section B4 are described in detail.

First, the rocking flapper 39 capable of rocking to switch the sheet paths for guiding the original document is described in detail.

As shown in FIG. 4, the rocking flapper 39 is switched to introduce the original document G to the reverse path P2 via the introduction path P1 to reverse the original document G whose images on one side have been read, to introduce the original document G to the delivery path P3 to send the original document G whose images on one side have been read onto the platen glass 1 again via the reverse path P2, or to introduce the original document G to the delivery path P3 to deliver the original document G whose images on one side have been read onto the original document delivery tray 34.

Figure 19:
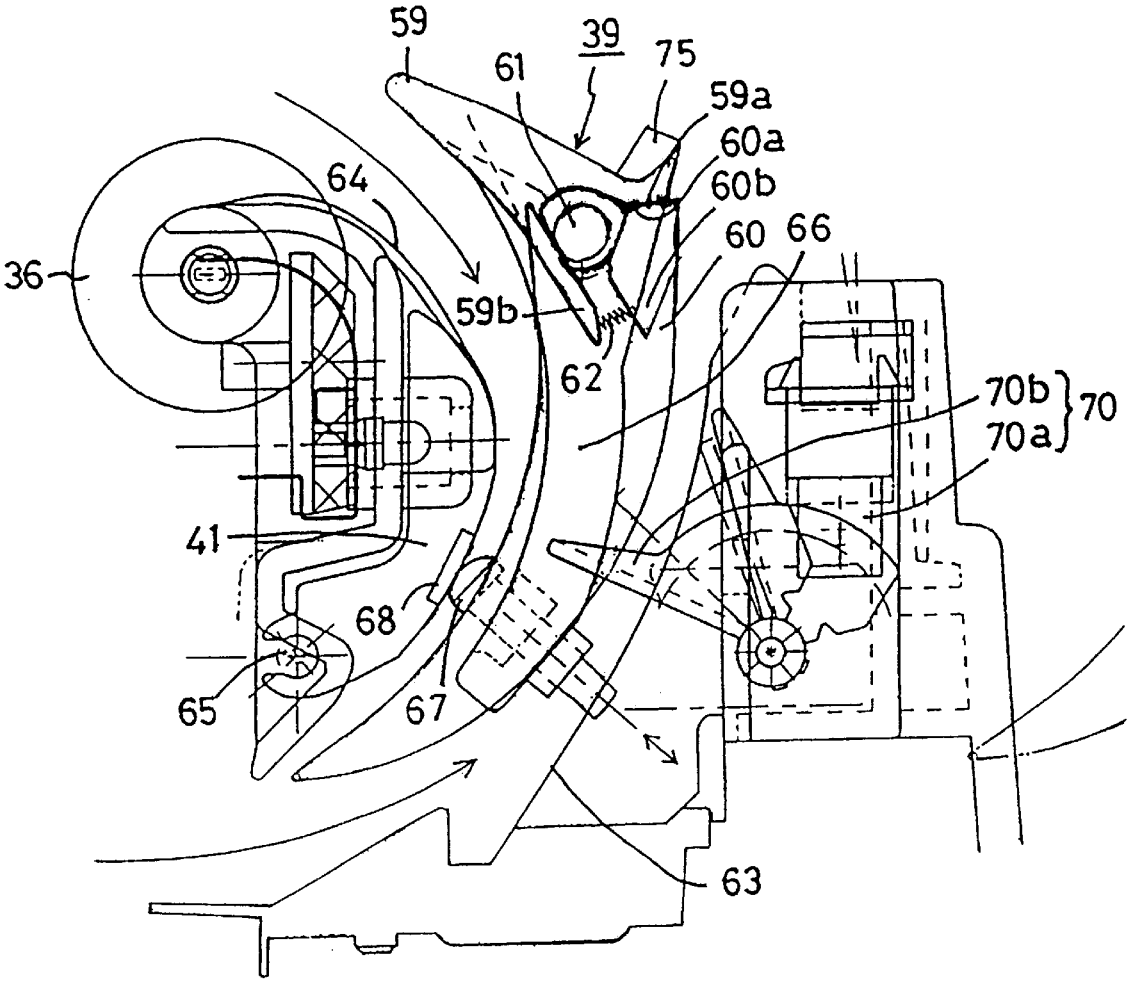
FIG. 19 is a cross-section of an essential portion showing the switching state of the divided rocking flapper.
Figure 20:
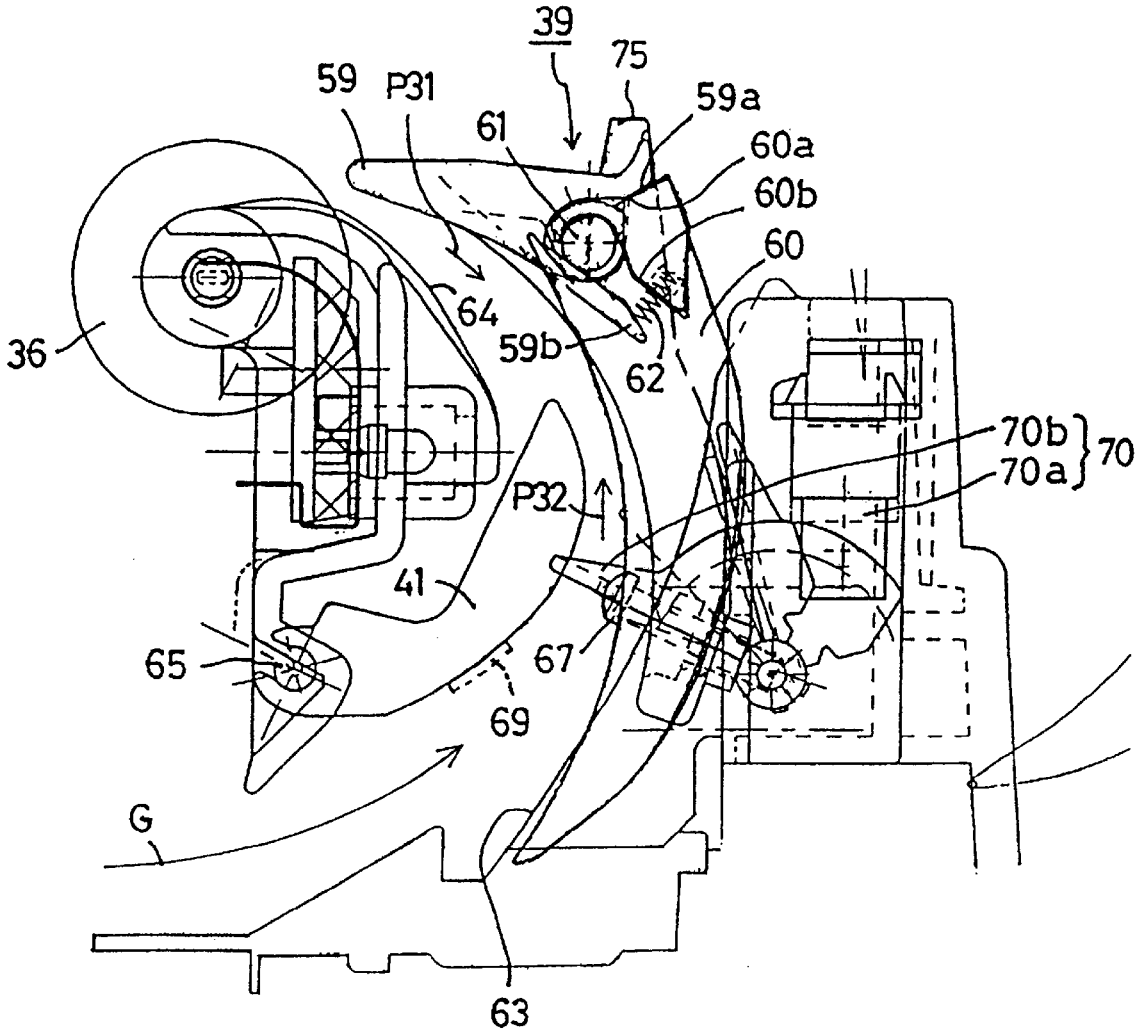
FIG. 20 is a cross-section of an essential portion showing the switching state of the divided rocking flapper.
Figure 21:
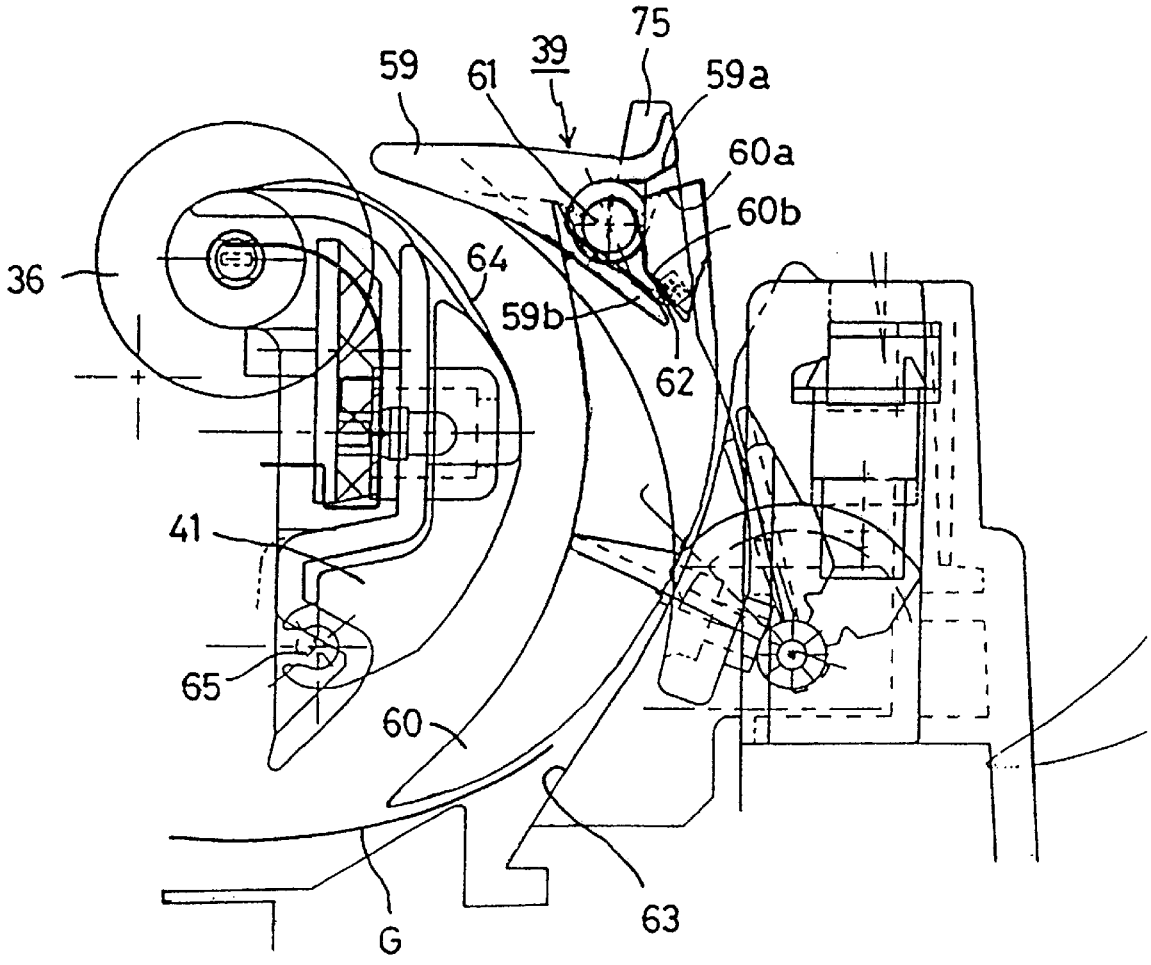
FIG. 21 is a cross-section of an essential portion showing the switching state of the divided rocking flapper.

The rocking flapper 39 is divided into two flappers and disposed on the same shaft as shown in FIG. 19, FIG. 20, and FIG. 21. With the divided rocking flapper 39, a first rocking flapper 59 as the one divided member is secured to a shaft 61, and a second rocking flapper 60 as the other divided member is pivotably attached to a shaft 61. The second rocking flapper 60 as the other can be moved pivotally by an elastic member 62 such as a coil spring upon pivotal movements of the first rocking flapper 59 as the one member.

More specifically, where the first rocking flapper 59 moves pivotally in a clockwise direction in FIG. 19, a contact portion 59*a* of the first rocking flapper 59 hits a contact portion 60*a* of the second rocking flapper 60 and pushes the portion, thereby pivotally moving the second rocking flapper 60 in the same direction (the clockwise direction) to the pivotal direction of the first rocking flapper 59, and thereby rocking the flapper 60 up to the position shown in FIG. 19. It is to be noted that the rocking flapper 39 stops at the position shown in FIG. 19 upon rocking movement, and this stop is done by turning-off operation of a torque limiter provided in a drive power transmission route in the delivery drive mechanism 58 (see, FIG. 24 and FIG. 25), which is described below in detail.

On the other hand, where the first rocking flapper 59 moves pivotally in a counterclockwise direction in FIG. 20, a contact portion 59*b* of the first rocking flapper 59 elastically pushes a contact portion 60*b* of the second rocking flapper 60 via the elastic member 62 such as a coil spring, thereby moving pivotally the second rocking flapper 60 in the same direction to the pivotal direction of the first rocking flapper 59.

If no front end of the original document exists in the rocking area of the rocking flapper 39 at that time, the second rocking flapper 60 moves to a position entering in a conveyance outer guide 63 as shown in FIG. 20. If a front end of the original document exists in the rocking area of the rocking flapper 39, the second rocking flapper 60 stops at a position offset by a portion of an original document thickness from the conveyance outer guide 63 as shown in FIG. 21 because the rigidity of the inter-placed original document overcomes the elastic force of the elastic member 62 located between the contact portions 59*b*, 60*b*, so that the second rocking flapper will not move up to the position shown in FIG. 20.

In this embodiment, when a front end of the original document is located between the rocking flapper 39 and the conveyance outer guide 63, the first rocking flapper 59 rotates by 23 degrees in the counterclockwise direction, but the second rocking flapper 60 stops upon rotating by 10 degrees in the counterclockwise direction where the front end of the original document G is clamped with the conveyance outer guide 63 therebetween, so that the remaining rotation of 13 degrees by the first rocking flapper 59 is to be absorbed by an elastic member 62 placed between the contact portions 59*b*, 60*b*.

As described above, the rocking flapper 39 capable of rocking to switch the sheet paths is structured to be able to rock to a position entering in the conveyance outer guide 63 when the flapper moves pivotally in the counterclockwise direction as shown in FIG. 20. However, as shown in, e.g., FIGS. 18(*a*) and 18(*b*), if a rocking flapper 39' is a unitedly molded product, the following problems may occur where a space between the proceeding original document and the subsequent original document is set narrow to raise the productivity.

That is, the front end of the subsequent conveyance original document waits between the rocking flapper 39' and the conveyance outer guide 63 while the proceeding conveyance original document is reversed and conveyed in the reverse path P2. However, if the rocking flapper 39' as the unitedly molded product is moved pivotally in the counterclockwise direction to convey and deliver the proceeding conveyance original document, the rocking flapper 39' as the unitedly molded product imposes stresses on the front end of the subsequent conveyance original document, and in the worst case, the original document may be folded or torn down.

To prevent this, in this embodiment, the rocking flapper 39 as described above is divided into two flappers and disposed on the same shaft; the first rocking flapper 59 as one member is secured to the shaft 61 whereas the second rocking flapper 60 as the other member is attached pivotally with respect to a shaft 61; where the first rocking flapper 59 as one member moves pivotally, the second rocking flapper 60 as the other member is moved pivotally.

Furthermore, if the second rocking flapper 60 is moved pivotally in the same direction to the pivotal movement of the first rocking flapper 59 in the counterclockwise direction in FIG. 20, and if a front end of the original document exists in the rocking area of the rocking flapper 39, the second rocking flapper 60 stops at a position offset by a portion of an original document thickness from the conveyance outer guide 63 as shown in FIG. 21 because the rigidity of the inter-placed original document overcomes the elastic force of the elastic member 62 located between the contact portions 59*b*, 60*b*, so that the second rocking flapper will not move up to the position shown in FIG. 20.

This structure can reduce stresses exerted to the front end of the original document G when the rocking flapper 39 is switched, while raising the productivity, thereby being capable of preventing inconveniences such as breakage of the original document.

{Following Flapper}

The following flapper 41 rocking in following the rocking movement of the rocking flapper 39 is described in detail.

The rocking flapper 39 is structured as to be capable of rocking from the position shown in FIG. 19 to the position shown in FIG. 20. However, for example, if the rocking flapper 39' is switched from the position shown in FIG. 18(*a*) to the position shown in FIG. 18(*b*) to excessively widen a space L (gap) of the delivery path P3 formed by the rocking flapper 39' and a conveyance inner guide 64, the original document G entering in the delivery path P3 has more freedom at the front end and may enter with a wider angle. This may cause the front end of the original document G to be bent or trapped as conveyed, possibly resulting in paper jamming.

As described above, the following flapper 41 is formed rocking in following the rocking movement of the rocking flapper 39. The following flapper 41 is attached pivotally to a projection 65 formed at each opposite end in the width direction (perpendicular to the conveyance direction) of the conveyance inner guide 64 as shown in FIG. 19 and FIG. 20.

As shown in FIG. 19, a contact portion 68 in a united body with the following flapper 41 is elastically pushed by an elastic contact portion 67 attached to an arm member 66 in a united body with the first rocking flapper 59, thereby keeping the situation shown in FIG. 19. It is to be noted that the arm member 66 in the united body with the first rocking flapper 59 and the contact portion 68 in the united body with the following flapper 41 are disposed at an end or ends in the axial direction as outside the conveyance area of the original document G. The elastic contact portion 67 attached to the arm member 66 in the united body with the first rocking flapper 59 is structured to be movable elastically in arrow directions in FIG. 19.

From the situation shown in FIG. 19, if the first rocking flapper 59 moves pivotally in the counterclockwise direction, the following flapper 41 is released from pushing motion of the elastic contact portion 67 of the arm member 66. At the same time, the following flapper 41 starts rocking in the clockwise direction around the projection 65 as a center by the weight of the flapper 41, and stops finally when hitting a stopper 69 (in this embodiment, a projection formed at a portion on a side plate constituting the frame of the original document conveying section B4), thereby forming a sheet path keeping a space (gap) in a prescribed amount as shown in FIG. 20.

With this structure, the space of the sheet path P31 formed between the rocking flapper 39 and the conveyance inner guide 64 when the rocking flapper 39 is rocked up to the position shown in FIG. 20 is maintained at a space of the sheet path P32 formed between the following flapper 41 and the rocking flapper 39, so that the front end of the original document G entering in the arrow direction in the drawing is positionally restricted, and so that bending or jamming of the conveyance original documents can be prevented.

A sensor flag 70*b* constituting a sheet sensor 70 for detecting the original document passing the sheet path P32 for the introduction path P1 and the delivery path P3 is formed at the introduction path P1 (on a side of the conveyance outer guide 63). However, when the rocking flapper 39' moves in the rocking manner to a position shown in FIG. 18(*b*), if the space of the delivery path P3 formed between the rocking flapper 39' and the conveyance inner guide 64 is too wide, the original document passing by the delivery path P3 may pass through a position where the sensor flag 70*b* cannot reach.

In such a case, with this invention, since the following flapper 41 restricting the path space of the delivery path P3 to the prescribed space is formed as rocking in following the rocking flapper 39 as described above, another sheet sensor for detecting the original document passing through the delivery path P3 is not necessary, and an original document passing through the sheet path P32 of the delivery path P3 can be surely detected by the sheet sensor 70 made of the sensor flag 70*b* and the photo sensor 70*a*.

{Engagement Flapper}

Figure 22:
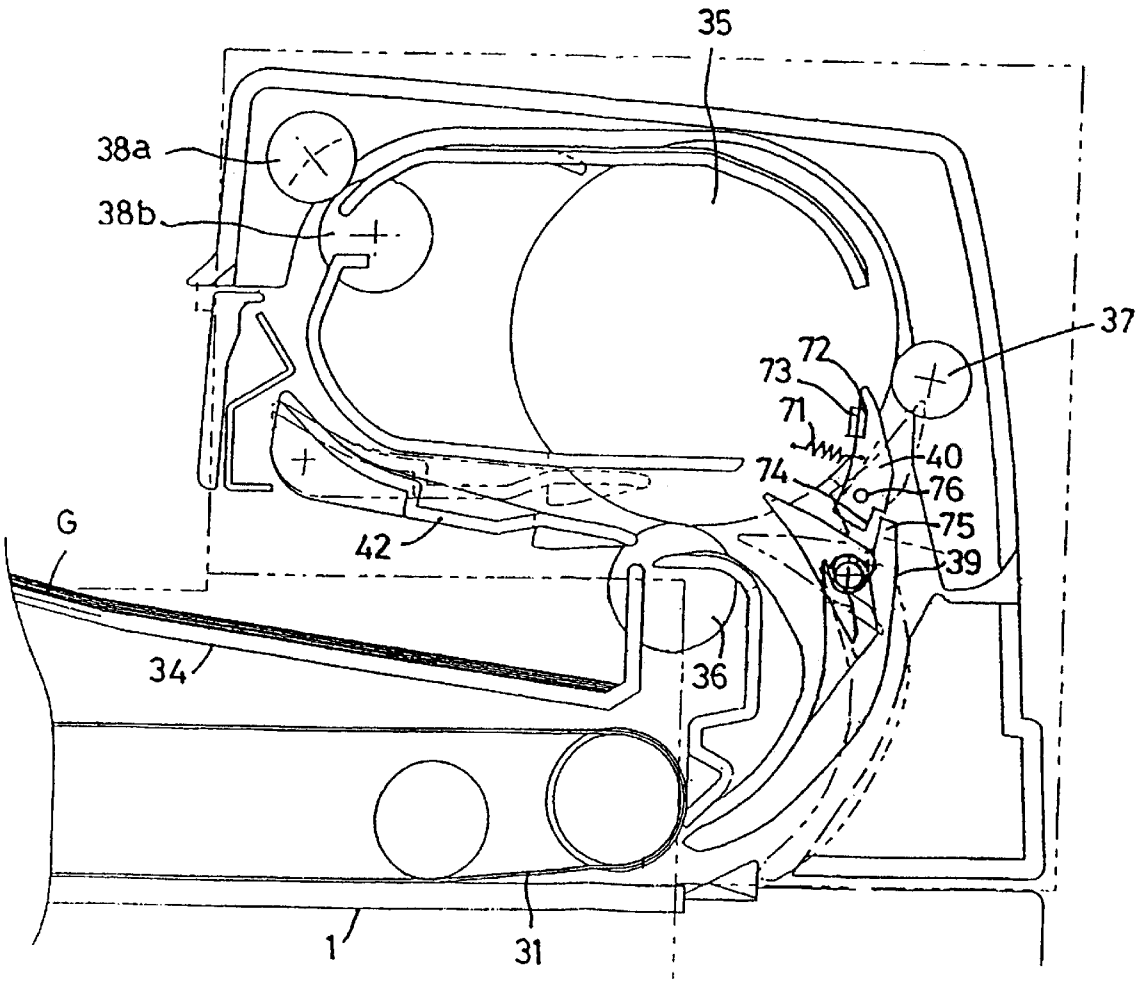
FIG. 22 is a cross-section of an essential portion showing the switching state of the rocking flapper and an engagement flapper.
Figure 23:
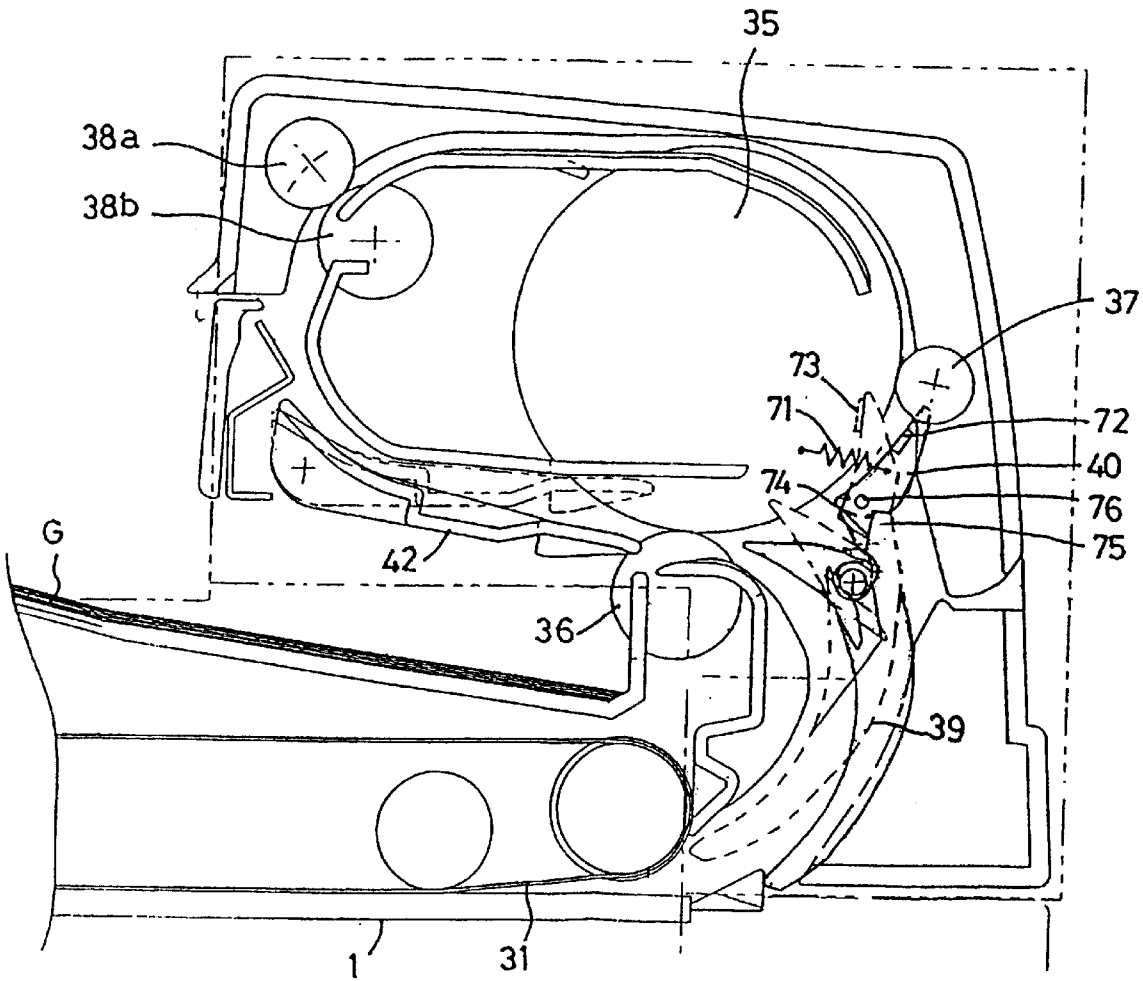
FIG. 23 is a cross-section of an essential portion showing the switching state of the rocking flapper and an engagement flapper.

The automatic original document conveying apparatus B has a structure including the rocking flapper 39, the following flapper 41, as described above, as well as the engagement flapper 40 as shown in FIG. 22 and FIG. 23. With the apparatus having a structure having plural flappers capable of thus rocking to switch the sheet paths, if the respective flappers are driven to be switched by drive means such as solenoids or motors, respectively, the costs becomes higher, and the apparatus structure and control sequence become so complicated.

In this embodiment, the engagement flapper 40 is arranged to engage with the rocking flapper 39 rocking by the delivery drive mechanism 58 (see, FIG. 24 to FIG. 26) as described below, and the engagement flapper 40 is rocked in association with the rocking movement of the rocking flapper 39. That is, a single drive means rocks the plural flappers.

Normally, the engagement flapper 40 is urged in a direction of the reverse roller by urging force of the urging member 71 such as a spring, but a contact portion 72 of the engagement flapper 40 hits a stopper 73 formed on a side plate constituting the frame of the original document conveying section B4 and is held at a position shown in FIG. 22 as a first position. In this state, as also shown in FIG. 22, an engagement portion 74 formed at the engagement flapper 40 and an engagement portion 75 formed at the rocking flapper 39 (or at the arm member 66 in the united body with the first rocking flapper 56 thereof) are isolated.

When the rocking flapper 39 moves pivotally in the counterclockwise direction around the shaft 61 as a center from the state shown in FIG. 22, the engagement portion 75 of the rocking flapper 39 engages with the engagement portion 74 of the engagement flapper 40 as shown in FIG. 23 and pushes the portion 74 in opposing the urging force of the urging member 71. The engagement flapper 40 therefore moves pivotally in the clockwise direction around the shaft 76 according to the pivotal movement of the rocking flapper 39 and is maintained at a position shown in FIG. 23 as a second position.

It is to be noted that if the engagement portion 75 of the rocking flapper 39 is disengaged from the engagement portion 74 of the engagement flapper 40, the engagement flapper 40 is rotated by urging force of the urging member 71 and maintained at a position shown in FIG. 22 as the original position upon hitting.

With this structure, the engagement flapper 40 is driven and switched by a drive mechanism 58 (as described below) for driving and switching the rocking flapper 39, and in other words, the plural flappers can be driven and switched by the single drive means, so that it is not necessary to provide drive means such as a solenoid or a motor for each flapper, and so that the costs would be reduced. Also, the apparatus structure and the control sequence can be simplified. With this apparatus, various sheet paths can be formed within a narrower space.

{Delivery Drive Mechanism}

Subsequently, the delivery drive mechanism 58 for driving the respective portions of the original document delivering section B4 is described in detail.

As described above, in an apparatus including plural flappers capable of rocking to switch the sheet paths, if the respect flappers are individually switched and driven by each drive means such as a solenoid or a motor, there raise problems such that the costs increase and that the apparatus structure and the control sequence become complicated.

Figure 26:
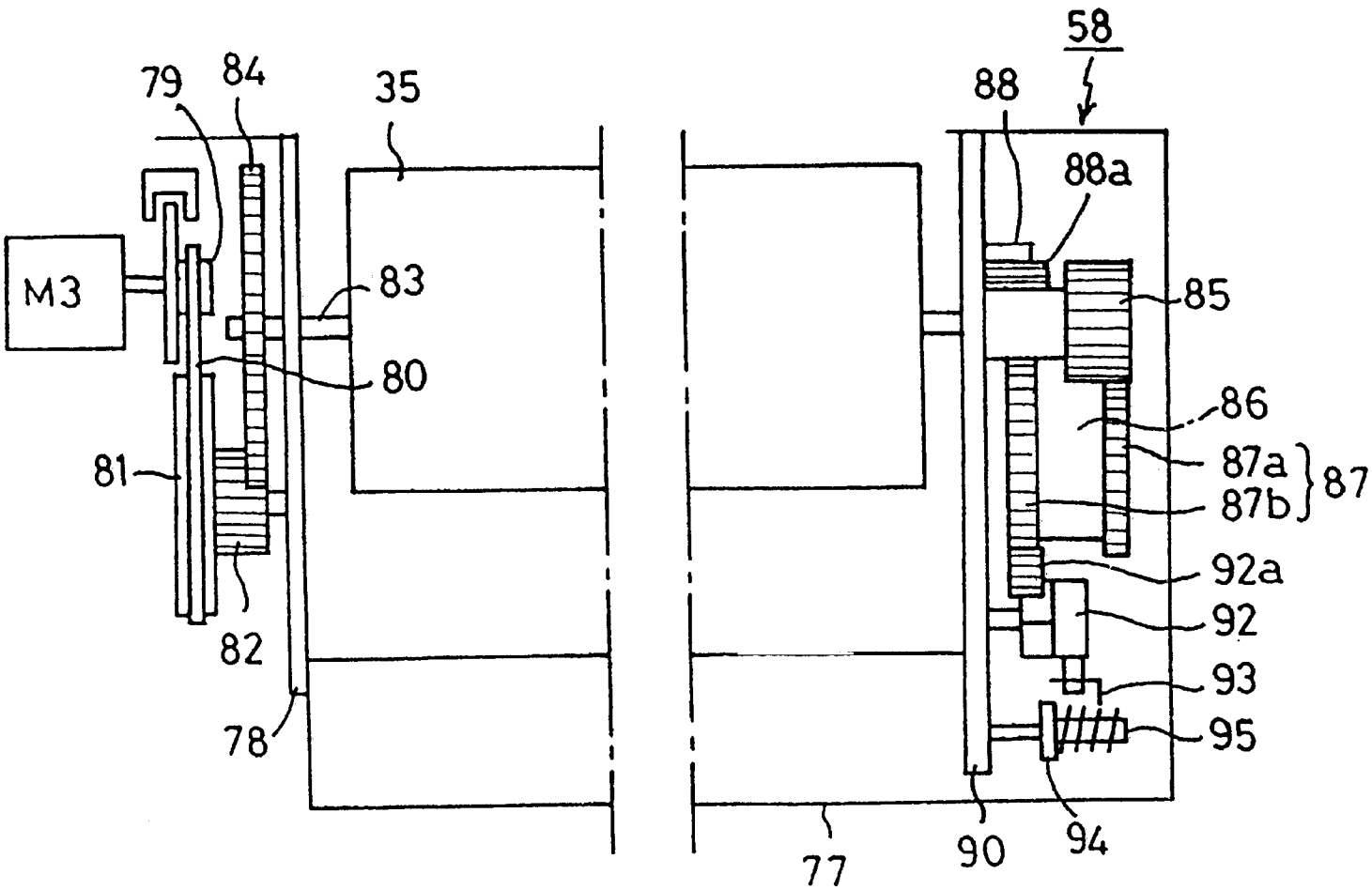
FIG. 26 is an illustration showing a part of a drive transmission route of the delivering drive mechanism.

In the delivery drive mechanism 58 in the automatic original document conveying apparatus B, as shown in FIG. 26, a single drive means operates the respective portions of the original document conveying section B4 by a drive transmission means constituted of gears or the like. It is to be noted that in this embodiment, a motor M3 capable of driving in normal and reverse directions is used as a drive means.

The motor M3 is attached to a one side plate 78 in the width direction constituting the frame 77 of the original document conveying section B4 as shown in FIG. 26. The power of the motor M3 is transmitted to a transmission pulley 81 from a motor pulley 79 via a timing belt 80 and transmitted to a reverse gear 84 formed at one end of a reverse roller shaft 83 in engagement with the transmission gear 82 formed in a united body with the transmission pulley 81. This renders the reverse roller 35 and the driven roller 36 rotatively driven by the roller 35, and the like driven rotatively in normal and reverse directions.

Figure 24:
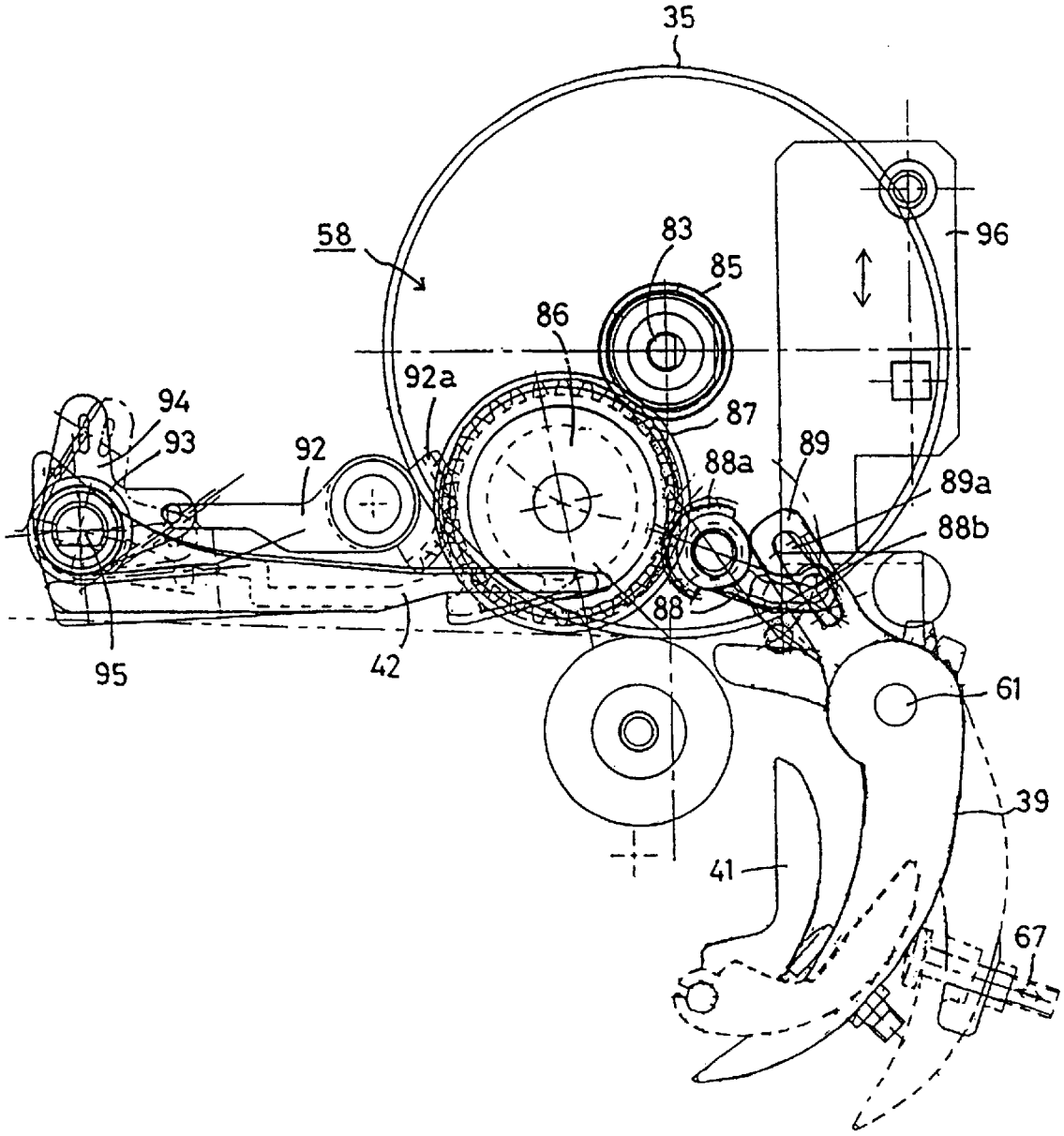
FIG. 24 is an illustration showing a part of a drive transmission route of a delivering drive mechanism.

The power of the motor M3 is, as shown in FIG. 26 and FIG. 24, transmitted to a reverse gear 85 on the other side via the reverse roller shaft 83 and then to an outer gear 87*a* of a step gear 87*a* including a torque limiter 86 in mesh with the reverse gear 85. The power transmitted to the outer gear 87*a* of the step gear 87*a* including the torque limiter 86 is further transmitted to a sector gear 88*a* in mesh with an inner gear 87*b* of the step gear 87, thereby moving in a rocking manner an arm member 88 having the sector gear 88*a*.

Figure 25:
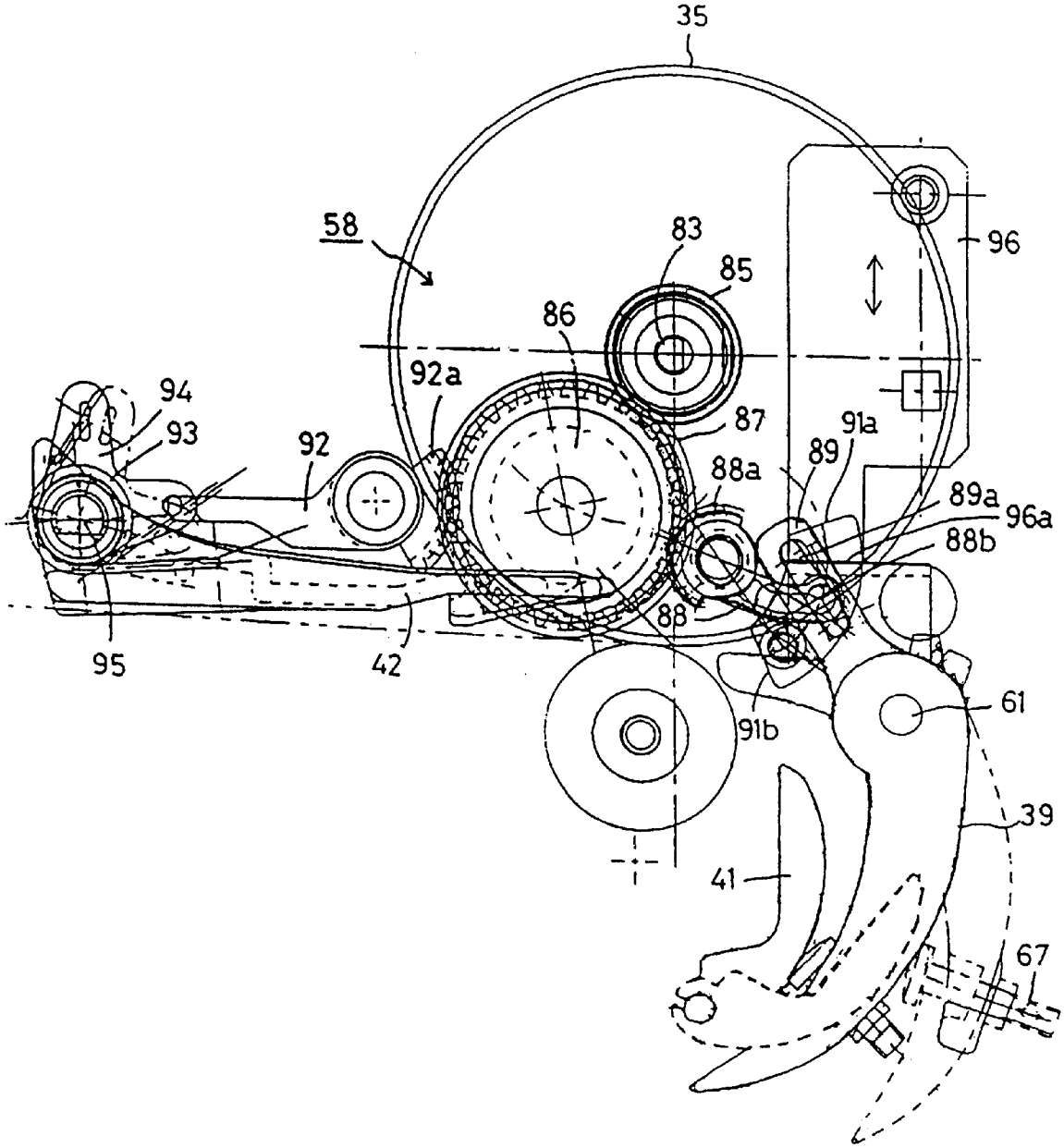
FIG. 25 is an illustration showing a part of a drive transmission route of the delivering drive mechanism.

According to this, as shown in FIG. 25, a projection 88*b* formed at a free end of the arm member 88, while being restricted to a long hole formed groove 89*a* formed at the arm member 89 secured to the shaft 61 of the rocking flapper 39 and restricted to a circle hole 91 formed in a side plate 90 on the other side in the width direction constituting the frame 77 of the original document conveying section B4, is moved pivotally, thereby rocking the rocking flapper 39 as described above. When the projection 88*b* stops in hitting the one end 91 a of the circle hole 91, the torque limiter 86 of the step gear 87 is made open to stop the rocking flapper 39 at the one position (the position shown in FIG. 19). When the projection 88*b* stops in hitting the other end 91*b* of the circle hole 91, the torque limiter 86 of the step gear 87 is made open to stop the rocking flapper 39 at the other position (the position shown in FIG. 20 or FIG. 21).

As described above, since it is not necessary to provide drive means such as a solenoid or a motor for each flapper, the costs can be reduced, and the apparatus structure and the control sequence can be simplified, so that electrical parts such as solenoids or the like or harness processing of those parts would be unnecessary.

It is to be noted that the power transmitted to the step gear 87 including the torque limiter 86 is also transmitted to another sector gear 92*a* in mesh with the inner gear 87*b* of the step gear 87, thereby rocking a lever 92 having the sector gear 92*a*. Through a twisted coil spring 93 engaged with a free end of the lever 92 and a V-shaped arm 94 in engagement with the twisted coil spring 93, a rocking guide 42 secured to a shaft 95 to which those are attached is rocked. The rocking guide 42 is also structured to stop upon rocking up to a prescribed position by turning-off of the torque limiter 86 of the step gear 87 in the same way as the rocking flapper 39.

The circle hole 91 formed in the side plate 90 limiting the rocking area of the projection 88*b* of the arm member 88, or namely the rocking area of the rocking flapper 39 is structured so that a limiting range as the hole range is adjustable in an arbitrary range. In this embodiment, as shown in FIG. 25, an adjustable plate 96 is slidably attached to the other side plate 90 in the width direction constituting the frame 77 of the original document conveying section B4, and where the adjustable plate 96 is moved up and down in the arrow directions, the position of the end 91 a serving as one contact portion of the circle hole 91 is changed by a contact portion 96a of the adjustable plate 96, thereby adjusting the limiting range of the circle hole 91 for restricting the projection 88*b* of the arm member 88 to be in an arbitrary range.

This structure allows adjusting the gap between the front end of the rocking flapper 39 and the conveyance belt 14 to be a prescribed gap easily. The gap between the front end of the rocking flapper 39 and the conveyance belt 14 is hardly compensated within the prescribed gap due to deviations in a peripheral length of the conveyance belt 14 and in accuracy of the parts of the rocking flapper 39, and if the gap is deviated, the deviation may disadvantageously cause the original document to be trapped between the front end of the rocking flapper 39 and the conveyance belt 14. Therefore, to use such an adjusting method thus described, the gap between the front end of the rocking flapper 39 and the conveyance belt 14 is guaranteed in a prescribed gap, so that conveying property is to be improved.

In a control sequence during the small size original document delivery mode in this apparatus, after when the motor M3 drives in a normal direction the original document G conveyed in a normal direction is introduced to the reverse path P2 via the introduction path P1 by the rocking flapper 39 and the engagement flapper 40 (see, FIGS. 6(*a*) through 6(*d*)), the motor M3 is driven reverse to convey the original document G in the reverse direction, and the original document G is conveyed in the normal direction in only an amount necessary to switch the engagement flapper 40 where the engagement flapper 40 is switched to introduce the original document to the conveyance path P4.

In this embodiment, as shown in FIG. 13 to FIG. 15, the motor M3 is driven reverse after passing a prescribed time (necessary for switching the engagement flapper 40) upon detecting the rear end of the original document by the sheet sensor 52 (commonly used as a register sensor) disposed around the engagement flapper, thereby switching the rocking flapper 39 and the engagement flapper 40 to positrons as shown in FIG. 23, and thereby conveying the original document G in the reverse direction in reverse rotating the reverse roller 35.

It is to be noted that the sheet sensor 52 serves not only as detecting the rear end of the original document G when the original document G is conveyed in the reverse direction as described above but also as detecting the front end of the original document G when the original document G is subject to a registration adjustment (oblique feeding correction). That is, when the original document G is sent to the reverse path P2 by the introduction path P1, the original document G is conveyed by rotatively driving the reverse roller 35 after detection of the front end of the original document G by means of the sheet sensor 52 and after oblique feeding correction is made by hitting the front end of the original document to a nip portion between the reverse roller 35 and the drive roller 37, which stop rotating. The sheet sensor 52 detects the end of the original document at that time.

With the structure thus described, the apparatus can prevent an inconvenience due to that the reversed original document G reaches the engagement flapper before the engagement flapper 40 is switched. Moreover, the sheet sensor 52 detecting the rear end of the original document uses a sheet sensor commonly serving as detecting the front end of the original document when the original document G is subject to the registration adjustment, so that the apparatus costs can be lowered and so that the apparatus structure and control sequence can be simplified.

[Other Embodiments]

Figure 27:
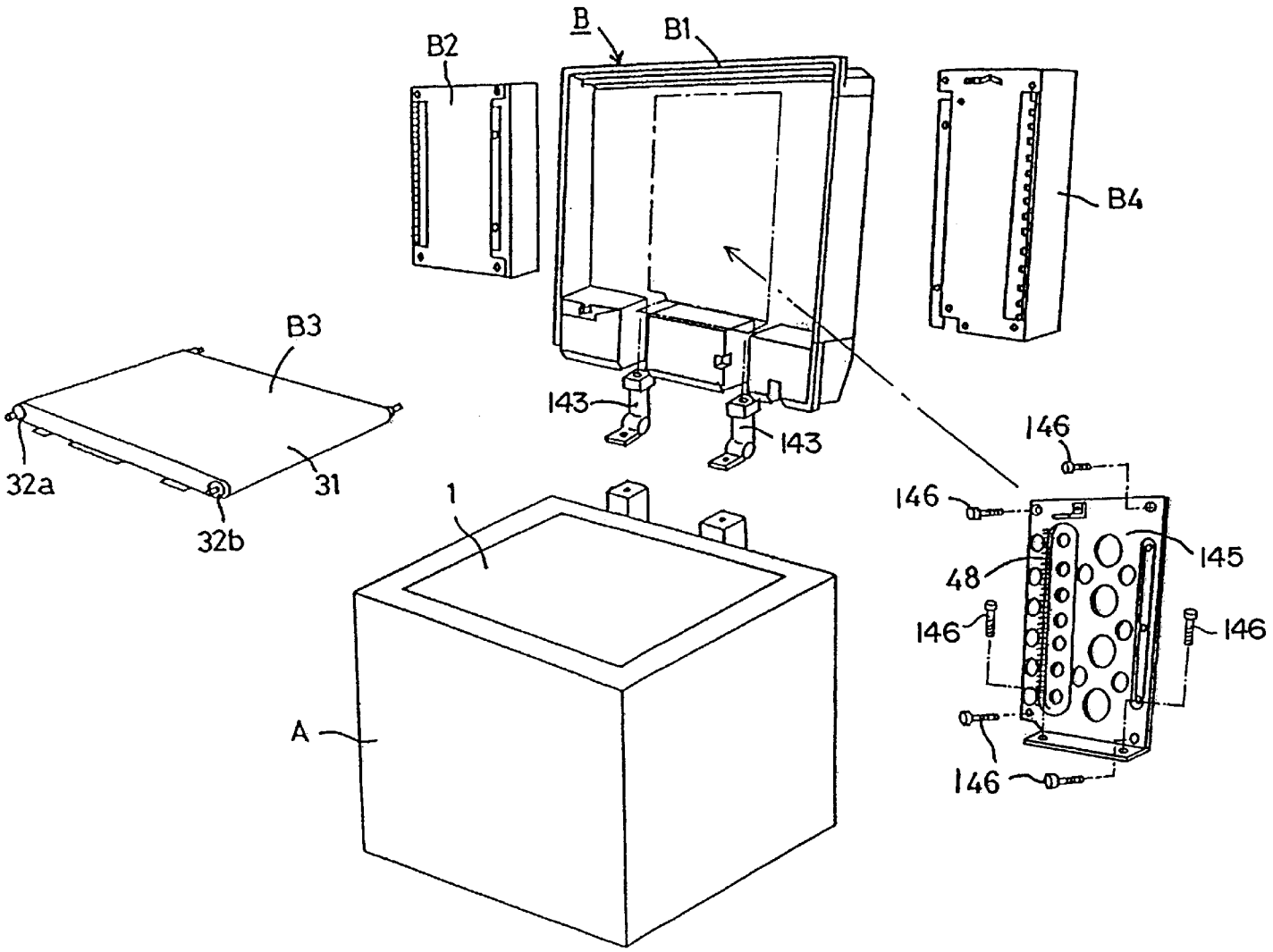
FIG. 27 is an illustration showing another structural example of a support plate and a hinge unit.
Figure 28:
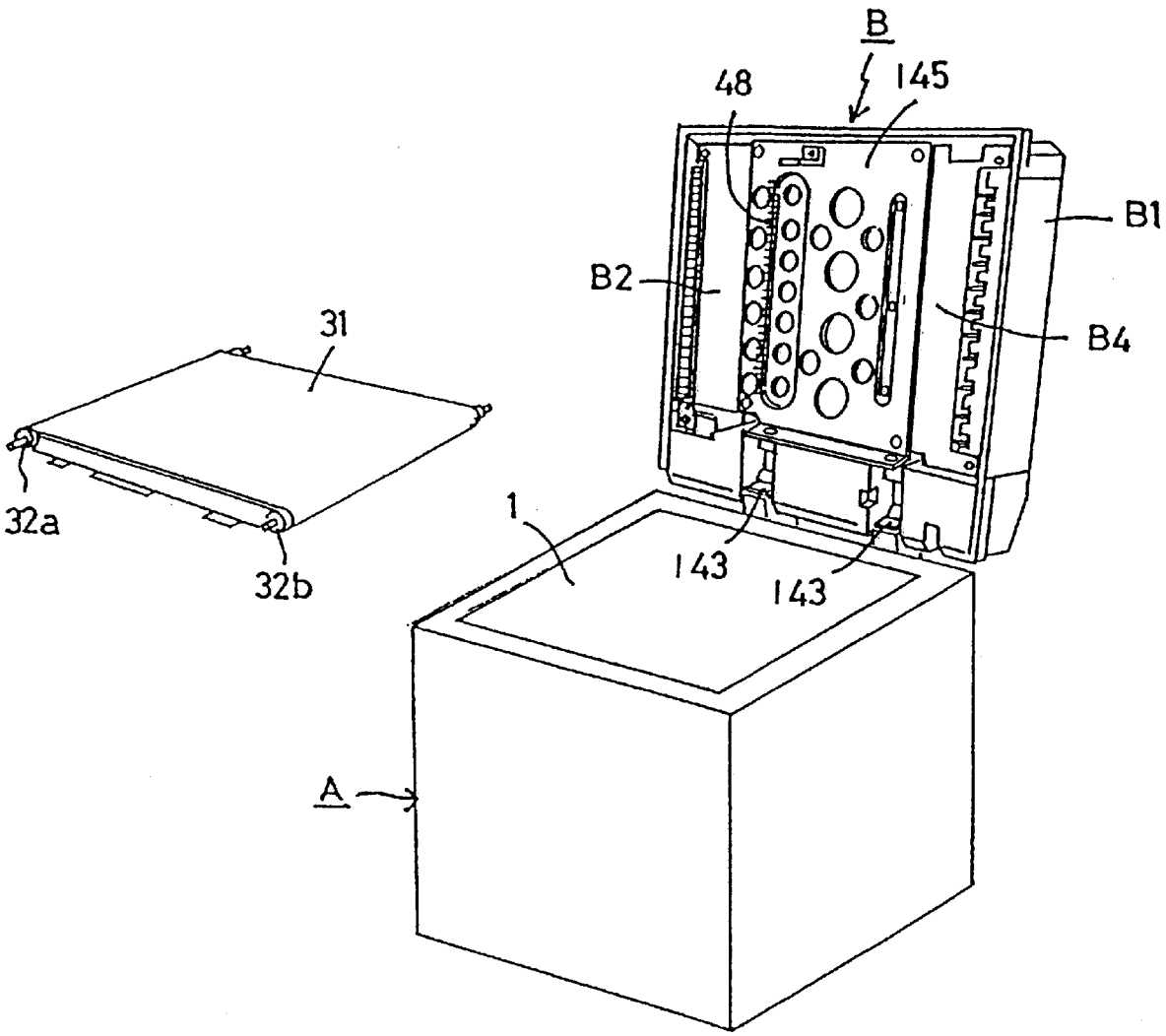
FIG. 28 is an illustration showing a state securely connecting respective units such as the original document feeding section, the original document delivering sections, etc. by the support plate.

Referring to FIG. 27 and FIG. 28, other embodiments according to the invention are described. An automatic original document conveying apparatus B in this embodiment includes, in the same manner as the automatic original document conveying apparatus B described above, a support plate 145 for securing respective units: an original document feeding section B2, an original document conveying section B3, and an original document delivering section B4, and a hinge unit 143 is attached to this support plate 145 directly by screws or the like to mount the automatic original document conveying apparatus B to the image forming apparatus body A.

According to this embodiment, since the support plate 145 securing the main units such as the original document conveying section or the like is directly secured to the image forming apparatus body A by the hinge unit 143, the rigidity of the monocoque frame 47 of the automatic original document reading apparatus B is not necessary, and the apparatus can realize a further lighter weight.

It is to be noted that if a part of the hinge unit 143 has a conductive property, the original document mounting section B1, the original document feeding section B2, the original document conveying section B3, and the original document delivering section B4 can be automatically grounded to a side of the image forming apparatus body A simply by attaching the hinge unit 143 to the support plate 145, and it is not necessary to provide an earth line E or the like as in the case of the support plate 45 described in reference to FIG. 10.

In the above embodiments, a photocopier is exemplified as an image forming apparatus, but this invention is not limited to this, and other image forming apparatuses such as scanners, printers, and facsimile machines can be exemplified. Substantially the same effects can be obtained by application of the invention to a sheet material feeding apparatus used for such an image forming apparatus.

In the above embodiments, a sheet feeding apparatus for feeding a sheet material such as recording paper or the like as an object for recording to a recording means is exemplified, but the invention is not limited to this, and substantially the same effects can be obtained by application of the invention to a sheet material feeding apparatus for feeding a sheet material such as an original document or the like as an object for reading to a reading means.

In the above embodiments, the electrophotographic method is exemplified as a recording method, but this invention is not limited to this, and for example, other recording methods such as an inkjet method or the like can be used.

Since this invention is thus structured, the frame does not require a high strength even where the original document mounting section is structured of a monocoque frame made of a synthetic resin by securely connecting the respective units to the support plate having a high strength. Therefore, it is not necessary to form a monocoque frame with a thick thickness as in a prior art, and the whole apparatus can be made lighter. Accordingly, the apparatus can improve the handling property and assembling property and can reduce the costs.

The earth structure of the respective units can be made easily by forming the support plate in a metal plate, and the charge eliminating member for eliminating charges in the conveyance belt constituting the original document conveying section can be easily assembled.

What is claimed is:

1. An automatic original document conveying apparatus for conveying a placed original document to a prescribed position and delivering the original document, the automatic original document conveying comprising:

an original document feeding unit for sequentially feeding an original placed document;

an original document delivering unit for delivering the fed original document; and a metal support plate, for securely connecting in a united body the original document feeding unit, the original document delivering unit, and a frame made of synthetic resin as to maintain respective assembled positions of the units.

2. The automatic original document conveying apparatus according to claim 1, and further comprising an original document conveying unit attached to the support plate for conveying to the delivering unit the original document fed from the original document feeding unit.

3. The automatic original document conveying apparatus according to claim 1, and further comprising an original document mounting unit for mounting an original document, wherein the support plate is secured to the original document mounting unit.

4. The automatic original document conveying apparatus according to claim 3, wherein the prescribed position is a reading position of an image reading apparatus, and wherein a hinge for pivotally attaching the automatic original document conveying apparatus to the reading apparatus is securely connected to the support plate.

5. The automatic original document conveying apparatus according to claim 2, and further comprising an original document mounting unit for mounting an original document, wherein the support plate is secured to the original document mounting unit.

6. The automatic original document conveying apparatus according to any of claim 3 to claim 5, wherein the original document mounting unit has a monocoque frame made of a synthetic resin.

7. The automatic original document conveying apparatus according to claim 5, wherein the prescribed position is a reading position of an image reading apparatus, and wherein a hinge for pivotally attaching the automatic original document conveying apparatus to the reading apparatus is securely connected to the support plate.

8. The automatic original document conveying apparatus according to claim 1, wherein the support plate is conductive, and the original document feeding unit and the original document delivering unit, which are securely connected, are grounded through the support plate.

9. The automatic original document conveying apparatus according to claim 2, wherein the support plate is conductive, and the original document feeding unit, the original document delivering unit, and the original document conveying unit, which are securely connected, are grounded through the support plate.

10. The automatic original document conveying apparatus according to any one of claims 2, 5, 7 or 9, wherein the support plate has a charge eliminating member which is in contact with a conveyance belt of the original document conveying unit for eliminating charges in the conveyance belt.

11. The automatic original document conveying apparatus according to claim 4 or 7, wherein the hinge is conductive, and static charges eliminated by the support plate are grounded through the hinge.

12. An image forming apparatus for forming images on a sheet upon reading an original document, comprising:

an automatic original document conveying apparatus having a metal support plate for securely connecting at least an original document feeding unit, an original document delivering unit, and a frame made of synthetic resin, in a united body so as to maintain the respective relative assembled positions; and an image forming apparatus body having a reading apparatus for reading original documents conveyed by the automatic conveying apparatus, a recording apparatus forming images on a recording medium according to read information; and a hinge member for pivotably supporting the automatic original document conveying apparatus to the image forming apparatus body.

13. The image forming apparatus according to claim 12, and further comparing an original document conveying unit attached to the support plate for conveying to the delivering unit the original document fed from the original document feeding unit.

14. The image forming apparatus according to claim 12, and further comparing an original document mounting unit for mounting an original document, wherein the support plate is secured to the original document mounting unit.

15. The image forming apparatus according to any one of claims 12 to 14, wherein the support plate is conductive, and the original document feeding unit and the original document delivering unit, which are securely connected, are grounded through the support plate.

16. The image forming apparatus according to claim 13, wherein the support plate has a charge eliminating member which is in contact with a conveyance belt of the original document conveying unit for eliminating charges in the conveyance belt.

* * * * *

UNITED STATES PATENT AND TRADEMARK OFFICE

CERTIFICATE OF CORRECTION

PATENT NO. : 6,347,213 B1 
DATED : February 12, 2002
INVENTOR(S) : Yuji Yamanaka et al.

It is certified that error appears in the above-identified patent and that said Letters Patent is hereby corrected as shown below:

Title page,
Item [57], ABSTRACT,
Line 5, "an original" should read -- a placed original --; and
Line 6, "placed" should be deleted.

Column 1,
Line 31, "in" should read -- to be --; and
Line 61, "as" should read -- so as --.

Figure 18A:
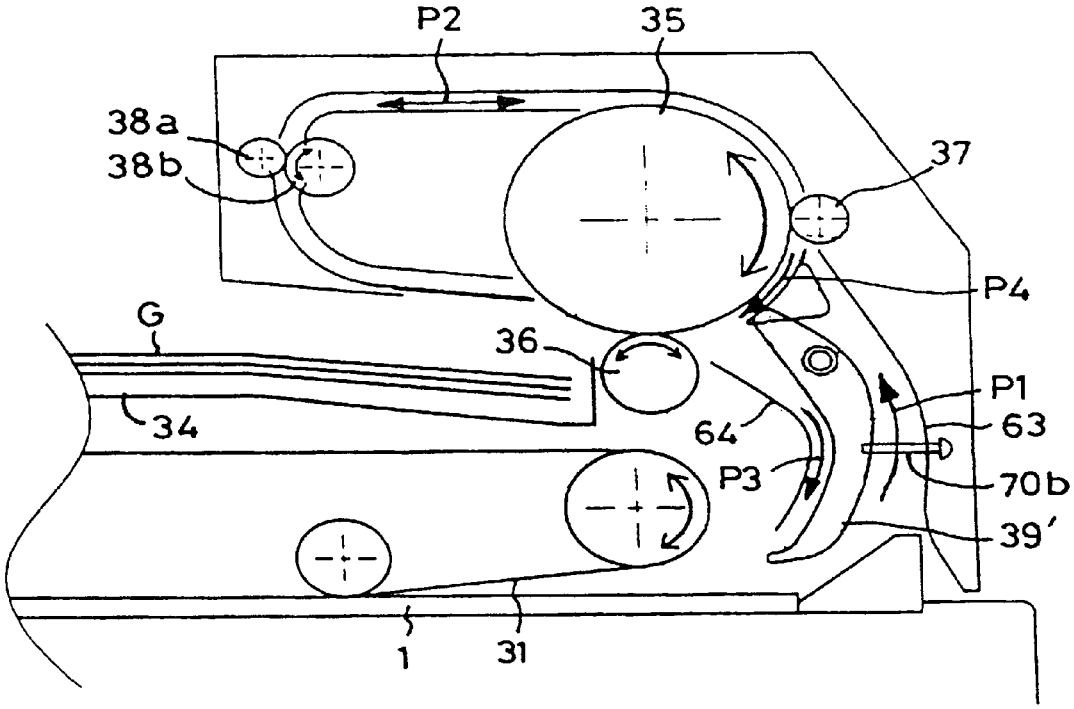
FIGS. 18 is a cross-section showing a switching state of a rocking flapper as a unitedly molded product.
Figure 18B:
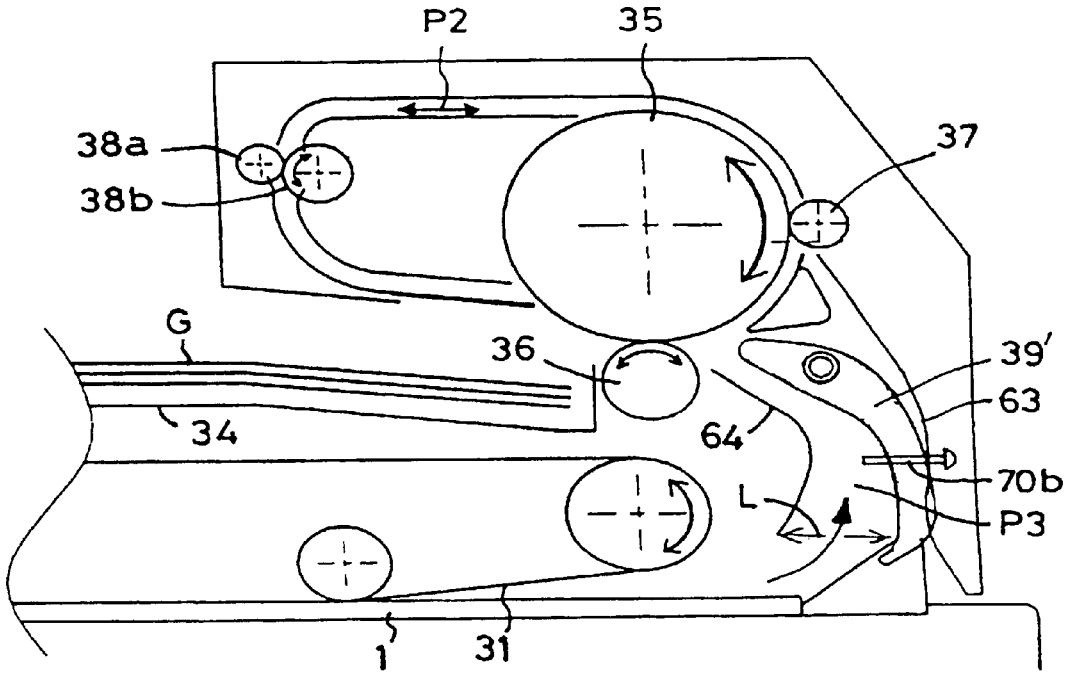

Column 3,
Line 1, "FIGS. 16(a)," should read -- FIGS. 16(a) and --;
Line 9, "cross sections" should read -- cross-sections; --;
Line 13, "FIGS. 18 is a cross-section" should read -- FIGS. 18(a) and 18(b) are cross-sections --; and
Line 39, "etc." should read -- etc., --.

Column 4,
Line 10, "driving" should read -- driven --;
Line 20, "obliquely" should read -- oblique --;
Line 25, "remained" should read -- remaining --;
Line 37, "switch-backed" should read -- switched back --;
Line 47, "operation." should read -- operation is described below. --;
Line 58, "Apparatus]" should read -- Apparatus} --; and
Line 66, "The" should read -- In the --.

Column 5,
Line 18, "passes" should read -- pass --;
Line 20, "and" should read -- and are --;
Line 24, "as" should read -- so as --; and
Line 32, "roller 37" should read -- roller 32a --.

Column 6,
Line 19, "(6(d)," should read -- 6(d)), --;
Line 27, "6(d)" should read -- 6(d)) --;
Line 33, "6(d)," should read -- 6(d)), --;
Line 38, "FIGS. 6(c) through 6(d)." should read -- FIGS. 6(c) and 6(d)). --;
Line 54, "belt 41" should read -- belt 31 --; and
Line 56, "delivery" should read -- deliver --.

UNITED STATES PATENT AND TRADEMARK OFFICE

CERTIFICATE OF CORRECTION

PATENT NO. : 6,347,213 B1
DATED : February 12, 2002
INVENTOR(S) : Yuji Yamanaka et al.

It is certified that error appears in the above-identified patent and that said Letters Patent is hereby corrected as shown below:

Column 8,
Line 3, “frame 45” should read -- frame 47 --;
Line 18, “to” should read -- to be --; and
Line 43, “conveyance” should read -- feeding --.

Column 9,
Line 30, “the” should be deleted; and
Line 61, “renders” should read -- makes --.

Column 10,
Line 11, “which” should read -- which are --; and
Line 56, “though” should read -- through --.

Column 11,
Line 39, “reverses the” should be deleted;
Lines 40 and 41, should be deleted;
Line 42, “document delivery tray 34;” should be deleted;
Line 46, “manner,” should read -- manner, by --; and
Line 53, “conveying” should read -- delivering --.

Column 14,
Line 14, “section B4),” should read -- section B3), --.

Column 15,
Line 2, “section B4” should read -- section B3 --;
Line 48, “section B4” should read -- section B3 --;
Line 55, “section B4” should read -- section B3 --; and
Line 67, “gear 87a” should read -- gear 87 --.

Column 16,
Line 2, “gear 87a” should read -- gear 87 --;
Line 12, “gear 87a” should read -- gear 87 --;
Line 15, “end 91 a” should read -- end 91a --;
Line 47, “section B4,” should read -- section B3, --;
Line 49, “end 91 a” should read -- end 91a --; and
Line 66, “in” should read -- to be in --.

UNITED STATES PATENT AND TRADEMARK OFFICE

CERTIFICATE OF CORRECTION

PATENT NO. : 6,347,213 B1
DATED : February 12, 2002
INVENTOR(S) : Yuji Yamanaka et al.

It is certified that error appears in the above-identified patent and that said Letters Patent is hereby corrected as shown below:

Column 17,
Line 2, “when” should be deleted;
Line 3, “direction” should read -- direction, --;
Line 18, “positrons” should read -- positions --; and
Line 56, “section B4,” should read -- section B4; --.

Column 18,
Line 47, “conveying” should read -- conveying apparatus --;
Line 49, “an original placed” should read -- a placed original --;
Line 56, “resin” should read -- resin, so --;
Line 59, “and” should be deleted; and
Line 64, “and” should be deleted.

Column 19,
Line 8, “and” should be deleted.

Column 20,
Line 9, “the” should be deleted;
Line 13, “a” should read -- said --;
Line 16, “pivotably” should read -- pivotally --;
Line 17, “to” should read -- on --;
Line 21, “and” should be deleted and “comparing” should read -- comprising --; and
Line 26, “and” should be deleted and “comparing” should read -- comprising --.

Signed and Sealed this

Twenty-ninth Day of October, 2002

*Attest:*

*Attesting Officer*

JAMES E. ROGAN
*Director of the United States Patent and Trademark Office*